US006346683B1

(12) United States Patent
Okutomi et al.

(10) Patent No.: US 6,346,683 B1
(45) **Date of Patent: *Feb. 12, 2002**

(54) VACUUM INTERRUPTER AND VACUUM SWITCH THEREOF

(75) Inventors: Tsutomu Okutomi, Kanagawa-ken; Takashi Kusano, Tokyo; Iwao Ohshima, Kanagawa-ken; Mitsutaka Homma, Saitama-ken; Atsushi Yamamoto, Tokyo; Takanobu Nishimura, Kanagawa-ken, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/495,317

(22) Filed: Feb. 1, 2000

(30) Foreign Application Priority Data

Feb. 2, 1999 (JP) ..... 11-025376

(51) Int. Cl.[7] ..... H01H 33/66
(52) U.S. Cl. ..... 218/123; 218/130
(58) Field of Search ..... 218/120, 123–128

(56) References Cited

U.S. PATENT DOCUMENTS 4,486,631 A * 12/1984 Naya et al. ..... 218/118
5,109,145 A * 4/1992 Fujita et al. ..... 218/118
5,409,519 A 4/1995 Seki et al.
5,420,384 A * 5/1995 Okutomi et al. ..... 218/68
5,500,499 A * 3/1996 Seki et al. ..... 218/130
5,726,407 A * 3/1998 Okutomi et al. ..... 218/130

FOREIGN PATENT DOCUMENTS

JP 3-108223 * 3/1991
JP 9-87775 3/1997

* cited by examiner

*Primary Examiner*—Lincoln Donovan
(74) *Attorney, Agent, or Firm*—Oblon, Spivak, McClelland, Maier & Neustadt, P.C.

(57) ABSTRACT

{W—$Cu_x$Sb-balance Cu} alloy is employed for contacts. As the anti-arcing constituent in the alloy W or WMo in a content of 65 to 85%, of grain diameter 0.4 to 9 μm is employed. As auxiliary constituent, $Cu_x$Sb is employed, the content of the $Cu_x$Sb being 0.09 to 1.4 weight %, the x being x=1.9 to 5.5, the grain diameter being 0.02 to 20 μm, and the mean distance between grains being 0.2 to 300 μm. As conductive constituent, Cu or CuSb solid solution is employed, the Sb content present in solid solution form in the CuSb solid solution being less than 0.5%. As a result, not only is dispersion of $Cu_x$Sb, which is evaporated on subjection to arcing, reduced, but also generation of severe cracks, which have an adverse effect in terms of occurrence of restriking. Arcing at the contacts surfaces is prevented, suppressing dispersion and exfoliation of W grains. In this way, damage due to melting and dispersion at the contacts surfaces is reduced, enabling both restriking to be prevented and the contact resistance characteristic to be improved.

36 Claims, 16 Drawing Sheets

| Conditions | Anti-arcing constituent (Content of anti-arcing constituent) | | | Auxiliary constituent CuxSb | | | | Conductive constituent Content of conductive constituent | | | Notes |
|---|---|---|---|---|---|---|---|---|---|---|---|
| | Type (weight%) | | Grain size (μm) | Type CuxSb | | Grain size (μm) | Mean distance between grains (μm) | Type | (Weight %) | Content of Sb in solid solution in Cu (weight %) | |
| W.E.[1], C.E.[2] | W | Mo | | X value | (Weight %) | | | | | | |
| C.E 1 | 60 | 0 | 1.5 | 2 | 0.11 | 7 | 25 | CuSb solid solution | balance | 0.01 | |
| W.E 1 | 65 | " | " | " | " | " | " | " | " | " | |
| " 2 | 75 | " | " | " | " | " | " | " | " | " | |
| " 3 | 85 | " | " | " | " | " | " | " | " | " | |

[1] Working Example

[2] Comparative Example

| Conditions | Anti-arcing constituent (Content of anti-arcing constituent) | | | Auxiliary constituent CuxSb | | | | Conductive constituent Content of conductive constituent | | | Notes |
|---|---|---|---|---|---|---|---|---|---|---|---|
| | Type (weight%) | | Grain size (μm) | Type CuxSb | | Grain size (μm) | Mean distance between grains (μm) | Type | (Weight %) | Content of Sb in solid solution in Cu (weight %) | |
| W.E.[1], C.E.[2] | W | Mo | | X value | (Weight %) | | | | | | |
| C.E 1 | 60 | 0 | 1.5 | 2 | 0.11 | 7 | 25 | CuSb solid solution | balance | 0.01 | |
| W.E 1 | 65 | " | " | " | " | " | " | " | " | " | |
| " 2 | 75 | " | " | " | " | " | " | " | " | " | |
| " 3 | 85 | " | " | " | " | " | " | " | " | " | |

[1] Working Example

[2] Comparative Example

*FIG. 1A*

| | | | | | | | | | | | |
|---|---|---|---|---|---|---|---|---|---|---|---|
| C.E. 2 | 92 | " | " | " | " | " | " | " | " | " | |
| W.E. 4 | 75 | 0.001 | " | " | " | " | " | " | " | " | |
| " 5 | " | 0.1 | " | " | " | " | " | " | " | " | |
| " 6 | " | 1 | " | " | " | " | " | " | " | " | |
| " 7 | " | 5 | " | " | " | " | " | " | " | " | |
| C.E. 3 | " | 12 | " | " | " | " | " | " | " | " | |
| " 4 | " | 0 | 0.1 | " | " | " | " | " | " | " | |
| W.E. 8 | " | " | 0.4 | " | " | " | " | " | " | " | |
| " 9 | " | " | 9 | " | " | " | " | " | " | " | |
| C.E. 5 | " | " | 15.0 | " | " | " | " | " | " | " | |
| " 6 | " | " | 1.5 | less than 1.9 | " | " | " | " | " | " | |
| W.E. 10 | " | " | " | 2.75 | " | " | " | " | " | " | |
| " 11 | " | " | " | 3 | " | " | " | " | " | " | |
| " 12 | " | " | " | 3.5 | " | " | " | " | " | " | |
| " 13 | " | " | " | 3.65 | " | " | " | " | " | " | |
| " 14 | " | " | " | 4.5 | " | " | " | " | " | " | |
| " 15 | " | " | " | 5.5 | " | " | " | " | " | " | |
| C.E. 7 | " | " | " | 2 | 0.03 | " | " | " | " | " | |
| W.E. 16 | " | " | " | " | 0.09 | " | " | " | " | " | |

*FIG. 1B*

| | | | | | | | | | | | |
|---|---|---|---|---|---|---|---|---|---|---|---|
| " 17 | " | " | " | " | 0.05 | " | " | " | " | " | |
| " 18 | " | " | " | " | 1.4 | " | " | " | " | " | |
| C.E. 8 | " | " | " | " | 2.3 | " | " | " | " | " | |
| " 9 | " | " | " | " | 0.11 | less than 0.02 | " | " | " | " | |
| W.E. 19 | " | " | " | " | " | 0.02 | " | " | " | " | |
| " 20 | " | " | " | " | " | 20.0 | " | " | " | " | |
| C.E. 10 | " | " | " | " | " | 34.0 | " | " | " | " | |
| " 11 | " | " | " | " | " | 7 | less than 0.2 | " | " | " | |
| W.E. 21 | " | " | " | " | " | " | 0.2 | " | " | " | |
| " 22 | " | " | " | " | " | " | 10 | " | " | " | |
| " 23 | " | " | " | " | " | " | 120 | " | " | " | |
| " 24 | " | " | " | " | " | " | 300 | " | " | " | |
| C.E. 12 | " | " | " | " | " | " | 600 | " | " | " | |
| W.E. 25 | " | " | " | " | " | " | 25 | " | " | 0.004 | |
| " 26 | " | " | " | " | " | " | " | " | " | 0.06 | |
| " 27 | " | " | " | " | " | " | " | " | " | 0.5 | |
| C.E. 13 | " | " | " | " | " | " | " | " | " | more than 0.5 | |

*FIG. 1C*

| | | | | | | | | | | | |
|---|---|---|---|---|---|---|---|---|---|---|---|
| W.E. 28 | " | " | " | " | " | " | " | " | Cu + CuSb solid solution | " | 0.01 |
| " 29 | " | " | " | " | " | " | " | " | Cu | " | 0 |

*FIG. 1D*

| | Restriking characteristic | Contact resistance characteristic | Notes | |
|---|---|---|---|---|
| Conditions<br><br>W.E./C.E. | Occurrence of restriking on interrupting a circuit of 6 KV × 500 A 20,000 times. (Disc-shaped contacts of diameter 30 mm, thickness 5 mm, one of their contact surfaces being of radius of curvature 250 mm, while the other was flat)<br>Relative comparison (times) taking W.E. 2 as 1.00 (Variability over 5 circuit breakers) | Relative comparison of ratio (y/x), taking W.E. 2 as 100, when the contact resistance of a new product (prior to the test) in a condition with a load of 1 kg and 24 V × 10 A applied was taken as (x) and the contact resistance after a test in which a circuit of 6 KV × 500 A was interrupted 20,000 times was taken as (y). (Variability over 5 circuit breakers) | Observations | Evaluation<br>O: good<br>X: bad |
| C.E. 1 | 1.34 ~ 2.16 | 42.4 ~ 61.8 | Poor withstand-voltage characteristic | X |
| W.E. 1 | 0.96 ~ 0.99 | 100.1 ~ 128.0 | | O |

*FIG. 2A*

| | | | | |
|---|---|---|---|---|
| " 2 | 1.00 | 100 | | O |
| " 3 | 0.93 ~ 0.95 | 118.6 ~ 142.5 | | O |
| C.E. 2 | 0.91 ~ 0.94 | 719.5 ~ 1634.9 | Increased contact resistance. Large value of temperature rise | X |
| W.E. 4 | 0.96 ~ 0.98 | 95.4 ~ 132.3 | | O |
| " 5 | 0.95 ~ 0.96 | 98.72 ~ 159.6 | | O |
| " 6 | 0.94 ~ 0.95 | 101.2 ~124.4 | | O |
| " 7 | 0.94 ~ 0.95 | 123.0 ~ 135.8 | | O |
| C.E. 3 | 0.96 ~ 1.36 | 128.7 ~ 273.2 | Excluded because of poor ability to suppress W chipping | X |
| " 4 | 2.66 ~ 3.18 | 90.5 ~ 99.6 | Difficult to reduce gas content in contacts | X |
| W.E. 8 | 0.88 ~ 0.90 | 95.2 ~ 110.0 | | O |
| " 9 | 0.96 ~ 1.02 | 102.4 ~ 138.2 | | O |
| C.E. 5 | 3.42 ~ 6.28 test stopped at 2.000 times | 118.9 ~ 784.6 | Severe variability of characteristic | X |
| " 6 | 0.98 ~ 4.18 | 98.0 ~ 124.1 | Large variability of composition depending on location. Poor base material | X |

*FIG. 2B*

| | | | | |
|---|---|---|---|---|
| W.E. 10 | 0.96 ~ 0.99 | 98.8 ~ 120.8 | | O |
| " 11 | 0.96 ~ 0.99 | 100.3 ~ 120.2 | | O |
| " 12 | 0.97 ~ 0.99 | 97.7 ~ 121.0 | | O |
| " 13 | 0.98 ~ 1.00 | 96.5 ~ 117.4 | | O |
| " 14 | 1.01 ~ 1.02 | 97.3 ~ 112.9 | | O |
| " 15 | 1.02 ~ 1.04 | 95.4 ~ 114.0 | | O |
| C.E. 7 | Mean of 4 of 5 breakers evaluated was 0.21. One only was 2.38, so was excluded. | 90.0 ~ 95.9 | Severe variability in restriking, depending on location in the composition. | X |
| W.E. 16 | 0.94 ~ 0.96 | 99.7 ~ 120.2 | | O |
| " 17 | 0.98 ~ 0.99 | 112.3 ~ 142.4 | | O |
| " 18 | 0.98 ~ 1.01 | 118.1 ~ 146.6 | | O |
| C.E. 8 | 2.02 ~ 6.62 test stopped at 1,500 times | 181.5 ~ 446.0 | Poor silver soldering | X |
| " 9 | Test was discontinued owing to difficulty of manufacturing contacts having composition in which CuxSb was finely dispersed. | Test was discontinued owing to difficulty of manufacturing contacts having composition in which CuxSb was finely dispersed. | (Difficulty of manufacturing contacts by only the fine structure part) | X |
| W.E. 19 | 0.95 ~ 0.97 | 97.1 ~ 111.1 | | O |

*FIG. 2C*

| | | | | |
|---|---|---|---|---|
| " 20 | 0.97 ~ 1.00 | 96.8 ~ 124.8 | | O |
| C.E. 10 | 0.99 ~ 2.46 | 216.3 ~ 417.4 | Variability of contact resistance | X |
| " 11 | Test stopped for same reason as C.E. 9. | Test stopped. | Excluded owing to high cost of manufacturing contacts | X |
| W.E. 21 | 0.92 ~ 0.94 | 95.3 ~ 112.0 | | O |
| " 22 | 0.98 ~ 1.04 | 108.8 ~ 133.5 | | O |
| " 23 | 1.02 ~ 1.12 | 96.1 ~ 139.8 | | O |
| " 24 | 1.04 ~ 1.24 | 103.4 ~ 144.7 | | O |
| C.E. 12 | 2.16 ~ 5.58 test stopped at 2,000 times. | 128.7 ~ 275.5 | Severe variability of both restriking and contact resistance characteristic | X |
| W.E. 25 | 0.90 ~ 0.92 | 98.3 ~ 114.3 | | O |
| " 26 | 0.96 ~ 0.99 | 100.7 ~ 132.0 | | O |
| " 27 | 0.98 ~ 1.02 | 105.9 ~ 145.5 | | O |
| C.E. 13 | 1.00 ~ 2.24 | 392.4 ~ 617.7 | Excluded due to severe drop in conductivity | X |
| W.E. 28 | 0.96 ~ 0.99 | 100.3 ~ 123.2 | | O |
| " 29 | 0.96 ~ 0.99 | 90.8 ~ 98.8 | | O |

*FIG. 2D*

| Conditions | Anti-arcing constituent (Content of anti-arcing constituent) | | | Auxiliary constituent CuxSb | | | | Conductive constituent Content of conductive constituent | | | Notes |
|---|---|---|---|---|---|---|---|---|---|---|---|
| | Type (weight%) | | Grain size (μm) | Type CuxSb | | Grain size (μm) | Mean distance between grains (μm) | Type | (Weight %) | Content of Sb in solid solution in Cu (weight %) | |
| W.E. C.E. | W | Mo | | X value | (Weight %) | | | | | | |
| C.E. 14 | 44 | 0 | 1.5 | 2 | 0.11 | 7 | 25 | CuSb solid solution | balance | 0.01 | |
| W.E. 30 | 50 | " | " | " | " | " | " | " | " | " | |
| " 31 | 60 | " | " | " | " | " | " | " | " | " | |
| " 32 | 75 | " | " | " | " | " | " | " | " | " | |
| C.E. 15 | 82 | " | " | " | " | " | " | " | " | " | |

*FIG. 3A*

| | | | | | | | | | | | |
|---|---|---|---|---|---|---|---|---|---|---|---|
| W.E. 33 | 60 | 0.001 | " | " | " | " | " | " | " | " | |
| " 34 | " | 0.1 | " | " | " | " | " | " | " | " | |
| " 35 | " | 1 | " | " | " | " | " | " | " | " | |
| " 36 | " | 5 | " | " | " | " | " | " | " | " | |
| C.E. 16 | " | 12 | " | " | " | " | " | " | " | " | |
| " 17 | " | 0 | 0.1 | " | " | " | " | " | " | " | |
| W.E. 37 | " | " | 0.4 | " | " | " | " | " | " | " | |
| " 38 | " | " | 9 | " | " | " | " | " | " | " | |
| C.E. 18 | " | " | 15.0 | " | " | " | " | " | " | " | |
| " 19 | " | " | 1.5 | less than 1.92 | " | " | " | " | " | " | |
| W.E. 39 | " | " | " | 2.75 | " | " | " | " | " | " | |
| " 40 | " | " | " | 3 | " | " | " | " | " | " | |
| " 41 | " | " | " | 3.5 | " | " | " | " | " | " | |
| " 42 | " | " | " | 3.65 | " | " | " | " | " | " | |
| " 43 | " | " | " | 4.5 | " | " | " | " | " | " | |
| " 44 | " | " | " | 5.5 | " | " | " | " | " | " | |
| C.E. 20 | " | " | " | 2 | 0.03 | " | " | " | " | " | |
| W.E. 45 | " | " | " | " | 0.09 | " | " | " | " | " | |
| " 46 | " | " | " | " | 0.05 | " | " | " | " | " | |

*FIG. 3B*

| | | | | | | | | | | | |
|---|---|---|---|---|---|---|---|---|---|---|---|
| " 47 | " | " | " | " | 1.4 | " | " | " | " | " | |
| C.E. 21 | " | " | " | " | 2.3 | " | " | " | " | " | |
| " 22 | " | " | " | " | 0.11 | less than 0.02 | " | " | " | " | |
| W.E. 48 | " | " | " | " | " | 0.02 | " | " | " | " | |
| " 49 | " | " | " | " | " | 20.0 | " | " | " | " | |
| C.E. 23 | " | " | " | " | " | 34.0 | " | " | " | " | |
| " 24 | " | " | " | " | " | 7 | less than 0.2 | " | " | " | |
| W.E. 50 | " | " | " | " | " | " | 0.2 | " | " | " | |
| " 51 | " | " | " | " | " | " | 10 | " | " | " | |
| " 52 | " | " | " | " | " | " | 120 | " | " | " | |
| " 53 | " | " | " | " | " | " | 300 | " | " | " | |
| C.E. 25 | " | " | " | " | " | " | 600 | " | " | " | |
| W.E. 54 | " | " | " | " | " | " | 25 | " | " | 0.004 | |
| " 55 | " | " | " | " | " | " | " | " | " | 0.06 | |
| " 56 | " | " | " | " | " | " | " | " | " | 0.5 | |
| C.E. 26 | " | " | " | " | " | " | " | " | " | more than 0.5 | |
| W.E. 57 | | | | | | | | Cu + | | 0.01 | |

*FIG. 3C*

| | Restriking characteristic | Contact resistance characteristic | Notes | |
|---|---|---|---|---|
| Conditions<br><br>W.E./C.E. | Occurrence of restriking on interrupting a circuit of 6 KV × 500 A 20,000 times. (Disc-shaped contacts of diameter 30 mm, thickness 5 mm, one of their contact surfaces being of radius of curvature 250 mm, while the other was flat)<br>Relative comparison (times) taking W.E. 2 as 1.00 (Variability over 5 circuit breakers) | Relative comparison of ratio (y/x), taking W.E. 2 as 100, when the contact resistance of a new product (prior to the test) in a condition with a load of 1 kg and 24 V × 10 A applied was taken as (x) and the contact resistance after a test in which a circuit of 6 KV × 500 A was interrupted 20,000 times was taken as (y). (Variability over 5 circuit breakers) | Observations | Evaluation<br>O: good<br>X: bad |
| C.E. 14<br><br>W.E. 30 | 1.31 ~ 2.05<br><br>0.86 ~ 0.90 | 40.2 ~ 58.7<br><br>95.1 ~ 121.6 | Poor withstand-voltage characteristic | X<br><br>O |

*FIG. 4A*

| | | | | |
|---|---|---|---|---|
| " 31 | 1.00 | 100 | | O |
| " 32 | 0.83 ~ 0.85 | 112.6 ~ 135.4 | | O |
| C.E. 15 | 0.81 ~ 0.84 | 883.5 ~ 1553.1 | Increased contact resistance. Large value of temperature rise | X |
| W.E. 33 | 0.86 ~ 0.88 | 90.6 ~ 125.6 | | O |
| " 34 | 0.85 ~ 0.86 | 98.7 ~ 159.6 | | O |
| " 35 | 0.84 ~ 0.85 | 96.1 ~ 118.2 | | O |
| " 36 | 0.84 ~ 0.85 | 116.8 ~ 129.0 | | O |
| C.E. 16 | 0.86 ~ 1.36 | 122.3 ~ 259.5 | Excluded because of poor ability to suppress W chipping | X |
| " 17 | 2.39 ~ 2.86 | 86.0 ~ 94.6 | Difficult to reduce gas content in contacts | X |
| W.E. 37 | 0.79 ~ 0.81 | 90.4 ~ 104.5 | | O |
| " 38 | 0.86 ~ 0.97 | 97.3 ~ 131.3 | | O |
| C.E. 18 | 3.08 ~ 5.65 test stopped at 2,000 times | 112.9 ~ 745.4 | Severe variability of characteristic | X |
| " 19 | 0.88 ~ 3.97 | 93.1 ~ 117.9 | Large variability of composition depending on location. Poor base material | X |

*FIG. 4B*

| | | | | |
|---|---|---|---|---|
| W.E. 39 | 0.86 ~ 0.89 | 93.9 ~ 114.8 | | O |
| " 40 | 0.86 ~ 0.89 | 95.3 ~ 114.2 | | O |
| " 41 | 0.87 ~ 0.89 | 92.8 ~ 115.0 | | O |
| " 42 | 0.88 ~ 1.00 | 91.7 ~ 111.5 | | O |
| " 43 | 0.90 ~ 0.95 | 92.4 ~ 107.3 | | O |
| " 44 | 0.97 ~ 0.95 | 90.6 ~ 108.3 | | O |
| C.E. 20 | Mean of 4 of 5 breakers evaluated was 0.21. One only was 2.36. | 85.5 ~ 91.1 | Severe variability in restriking, depending on location in the composition. | X |
| W.E. 45 | 0.84 ~ 0.86 | 94.7 ~ 114.2 | | O |
| " 46 | 0.88 ~ 0.89 | 106.7 ~ 135.3 | | O |
| " 47 | 0.88 ~ 0.96 | 112.3 ~ 139.3 | | O |
| C.E. 21 | 1.92 ~ 6.29 test stopped at 1,500 times | 172.4 ~ 423.7 | Poor silver soldering | X |
| " 22 | Test was discontinued owing to difficulty of manufacturing contacts having composition in which CuxSb was finely dispersed. | Test was discontinued owing to difficulty of manufacturing contacts having composition in which CuxSb was finely dispersed. | (Difficulty of manufacturing contacts by only the fine structure part) | X |
| W.E. 48 | 0.85 ~ 0.87 | 92.2 ~ 105.5 | | O |

*FIG. 4C*

| | | | | |
|---|---|---|---|---|
| " 49 | 0.87 ~ 0.90 | 92.0 ~ 118.6 | | O |
| C.E. 23 | 0.89 ~ 2.34 | 205.5 ~ 396.5 | Variability of contact resistance | X |
| " 24 | Test stopped for same reason as C.E. 22. | Test stopped. | Excluded owing to high cost of manufacturing contacts | X |
| W.E. 50 | 0.82 ~ 0.84 | 90.5 ~ 106.4 | | O |
| " 51 | 0.98 ~ 1.04 | 103.4 ~ 126.8 | | O |
| " 52 | 0.93 ~ 1.06 | 91.3 ~ 132.8 | | O |
| " 53 | 0.93 ~ 1.11 | 98.2 ~ 137.5 | | O |
| C.E. 25 | 1.94 ~ 5.30 test stopped at 2,000 times. | 122.3 ~ 261.7 | Severe variability of both restriking and contact resistance characteristic | X |
| W.E. 54 | 0.80 ~ 0.82 | 93.4 ~ 108.6 | | O |
| " 55 | 0.86 ~ 0.89 | 95.7 ~ 125.4 | | O |
| " 56 | 0.88 ~ 0.97 | 100.6 ~ 138.2 | | O |
| C.E. 28 | 1.90 ~ 5.30 | 372.8 ~ 586.8 | Excluded due to severe drop in conductivity | X |
| W.E. 57 | 0.86 ~ 0.89 | 95.3 ~ 117.0 | | O |
| " 58 | 0.86 ~ 0.89 | 86.3 ~ 93.9 | | O |

*FIG. 4D*

VACUUM INTERRUPTER AND VACUUM SWITCH THEREOF

BACKGROUND OF THE INVENTION

1. Field of the Invention

The present invention relates to a vacuum interrupter that performs interruption/conduction of current in vacuum, and to a vacuum switch wherein this vacuum interrupter is mounted, more particularly, it relates to improvements in the contact resistance characteristic and restriking characteristic of the contacts of the vacuum interrupter.

2. Description of the Related Art

In order to maintain or improve, apart from the three fundamental requirements typified by the anti-welding characteristic, voltage withstanding characteristic and interruption characteristic, the current chopping characteristic, erosion characteristic, contact resistance characteristic and temperature rising characteristic etc., the contacts of vacuum interrupters mounted in a vacuum switch or vacuum circuit breaker are constituted of various base materials. However, it is considered to be impossible for these to be fully satisfied by a single element, since the above required characteristics often demand mutually contradictory material properties.

Accordingly, contact materials have been developed for specific applications such as large current interruption applications or high withstand-voltage applications, by use of composite materials or by base material cladding etc., and these exhibit excellent characteristics in their own way. For example, as contact materials for large current interruption satisfying the three fundamental requirements, there are known Cu—Bi alloys, or Cu—Te alloys containing 5 weight % or less of anti-welding constituents such as Bi or Te (Issued Japanese patent Sho. 41-12131, and Issued Japanese patent number Sho. 44-23751).

Cu—Bi alloy has excellent large-current interruption characteristics, since a low welding separation force is achieved by the embrittlement of the alloy itself which is produced by the presence of brittle Bi segregated at grain boundaries. Likewise, Cu—Te alloy has excellent large-current interruption characteristics, since a low welding separation force is achieved by the embrittlement of the alloy itself which is produced by the presence of brittle $Cu_2Te$ segregated at grain boundaries and inner grains.

In contrast, Cu—Cr alloy is known as a contact material for high withstand-voltage/large current interruption use. This alloy has a smaller vapor pressure difference between its structural constituents than have the aforementioned Cu—Bi alloy or Cu—Te alloy, and so has the advantage that it can be expected to exhibit uniform performance, and indeed is excellent, depending on the application. Cu—W is also known as a high withstand-voltage contact material. These alloys exhibit excellent anti-arcing characteristics, on account of the effect of the high melting point materials.

In a vacuum circuit breaker and/or vacuum switch, the phenomenon may be induced that, after current interruption, flashover occurs within the vacuum interrupter, causing a conductive condition between the contacts to be re-established (subsequent discharge does not continue). This phenomenon is called the restriking phenomenon, but the mechanism of its occurrence has not yet been elucidated. Abnormal over-voltages frequently occur on account of the rapid change to a conductive condition after the electrical circuit was first put in the current-interrupted condition. In particular, in tests wherein restriking was produced on interruption of a condenser bank, the occurrence of extremely large over-voltages and/or excessive high-frequency current was observed. The development of a technique for lowering the probability of restriking is therefore sought.

Although, as described above, the mechanism of occurrence of the restriking phenomenon is not known, according to the experimental results of the inventors, restriking occurs with fairly high frequency between one contact and another contact or between the contacts and the arc shield within the vacuum interrupter. Accordingly, the inventors succeeded in greatly reducing the number of occurrences of restriking by discovering that techniques for suppressing abrupt gas that is discharged for example when the contacts are subjected to arcing and techniques for optimization of the contact surface condition are extremely effective in lowering the probability of restriking.

In recent years, however, to meet demands for improving the voltage withstanding performance and demands for improving the large current interruption performance of vacuum interrupters, in particular demands for miniaturization, further reductions in restriking of the contacts are required. Specifically, in recent years, severity of the conditions of use demanded by users and of the variety of loads have increased. A marked recent trend is increasingly frequent application to reactor circuits and capacitor circuits. The development and improvement of contact materials for this has become an urgent task.

In the case of capacitor circuits, about two or three times of the usual voltages are applied, so the surface of the contacts is severely damaged by arcing during the current interruption or current switching, and, as a result, surface roughening and exfoliative erosion of the contacts is promoted. Such surface roughness and/or exfoliation increases contact resistance, and is believed to be a factor causing restriking. Thus, although it is unclear which is the initial trigger, cause and effect are repeated, with the result that the frequency of occurrence of restriking and the contact resistance both increase. However, notwithstanding the importance of the phenomenon of restriking from the point of view of product reliability, and neither a way of preventing it nor its direct causes have yet been elucidated.

When the inventors observed in detail the correlation with occurrence of restriking of the total quantity of gas discharged in the heating step of Cu—W alloy or Cu—Mo alloy, the type of gas and its mode of discharge, they discovered that, in the case of contacts where there was considerable abrupt discharge of gas in pulse fashion in the vicinity of the melting point, albeit for a very short time, the rate of restriking was also high.

Accordingly, the restriking phenomenon was reduced by subjecting the Cu, W raw material or Cu, Mo raw material or Cu—W contact alloy or Cu, Mo contact alloy beforehand to heating in the vicinity of the melting temperature or above the melting temperature, or removing beforehand factors causing the discharge of abrupt gas in the Cu—W alloy or Cu, Mo contact alloy, or high temperature aging of the Cu—W contact surface layer or Cu—Mo contact surface layer or by improving sintering techniques so as to suppress pores and/or structural segregation in the Cu—W alloy or Cu—Mo alloy.

However, with the further demands for suppression of restriking in recent years, the need for further improvements has been recognized and in particular development of other strategies has become important.

As described above, for high withstand-voltage contact materials, Cu—W alloy or Cu—Mo alloy were used in preference to the Cu—Bi alloy, Cu—Te alloy or Cu—Cr alloy described above, but in fact they cannot be described as contact materials that can fully meet the increasingly severe requirements for reduction of restriking. Specifically, even in the case of Cu—W alloy or Cu—Mo alloy which have been preferentially used hitherto, occurrence of restriking in more severe high voltage regions and in circuits where there is rush current, or the existence of instability of the contact resistance characteristic caused by the material properties of the Cu—W alloy or Cu—Mo alloy have been identified as problems.

Accordingly, the development of contact material for vacuum interrupters having in particular excellent restriking characteristics and contact resistance characteristics, while still maintaining a certain level of the aforementioned fundamental three requirements, is desired.

SUMMARY OF THE INVENTION

Accordingly, one object of the present invention is to provide a novel vacuum interrupter and vacuum switch in which this is mounted, comprising contacts whose contact resistance characteristic and restriking characteristic can be simultaneously improved, by optimizing the metallurgical conditions of the Cu—W alloy or Cu—Mo alloy.

In order to achieve the above object, in a vacuum interrupter that performs current interruption/conduction by opening/closure of contacts in vacuum, the contacts referred to above are manufactured of contact material constituted by, as anti-arcing constituent, W of mean grain size 0.4 to 9 $\mu$m and 65 to 85 weight %, as restriking stabilization auxiliary constituent, 0.09 to 1.4 weight % of $Cu_xSb$ chemical compound, and, as conductive constituent, Cu or CuSb alloy as the balance.

If the mean grain size of the W exceeds 6 $\mu$m, uniform dispersion of the $Cu_xSb$ chemical compound is impeded. If this is less than 0.4 $\mu$m, there is a considerable amount of gas left in the base material, which is undesirable for contact material. If the W content is in the range 65 to 82 weight %, the contact resistance characteristic and restriking characteristic coexist in a desired range. If the W content is more than 82 weight %, the contact resistance characteristic is impaired, while if the W content is less than 70 weight % the restriking characteristic is impaired. If the content of $Cu_xSb$ chemical compound is in the range 0.09 to 1.4%, the contact resistance characteristic and restriking characteristic coexist in a desired range. If the content of $Cu_xSb$ chemical compound is more than 1.4%, the contact resistance characteristic and restriking characteristic are both adversely affected. If the content of $Cu_xSb$ chemical compound is less than 0.09%, control of the Sb content in the contacts alloy is difficult, a uniform dispersion and distribution of the Sb constituent at the contact surface is not obtained, and the contact resistance characteristic and restriking characteristic are both adversely affected.

Furthermore, in a vacuum interrupter that performs current interruption/conduction by opening/closure of contacts in vacuum, the contacts referred to above are manufactured of contact material constituted by, as anti-arcing constituent, in integrated form and size in the range 0.4 to 10 $\mu$m, W of mean grain size 0.4 to 9 $\mu$m and 65 to 85 weight % and Mo of mean grain size 0.4 to 9 $\mu$m of 0.001 to 5 weight % and as restriking stabilization auxiliary constituent, 0.09 to 1.4 weight % of $Cu_xSb$ chemical compound, and, as conductive constituent, Cu or CuSb alloy as the balance.

The presence of a prescribed small content of Mo improves the plastic deformation capability of W in regard to thermal or mechanical shock to which the W is subjected during circuit braking action or switching action, and thus has the benefit of suppressing chipping of W in extremely minute, micro-scale portions. It therefore contributes to reduction of in particular the range of variability of the frequency of occurrence of restriking. If the Mo content exceeds 5 weight %, its benefit is lessened.

Yet further, in a vacuum interrupter that performs current interruption/conduction by opening/closure of contacts in vacuum, the contacts referred to above are manufactured of contact material constituted by, as anti-arcing constituent, Mo of mean grain size 0.4 to 9 $\mu$m and 50 to 75 weight %, as restriking stabilization auxiliary constituent, 0.09 to 1.4 weight % of $Cu_xSb$ chemical compound, and, as conductive constituent, Cu or CuSb alloy as the balance.

If the mean grain size (diameter) of the Mo exceeds 9 $\mu$m, uniform dispersion of the $Cu_xSb$ chemical compound is impeded. If this is less than 0.4 $\mu$m, there is a considerable amount of gas left in the base material, which is undesirable for contact material. If the Mo content is in the range 50 to 75 weight %, the contact resistance characteristic and restriking characteristic coexist in a desired range. If the Mo content is more than 75 weight %, the contact resistance characteristic is impaired, while if the Mo content is less than 50 weight % the restriking characteristic is impaired. If the content of $Cu_xSb$ chemical compound is in the range 0.09 to 1.4%, the contact resistance characteristic and restriking characteristic coexist in a desired range. If the content of $Cu_xSb$ chemical compound is more than 1.4%, the contact resistance characteristic and restriking characteristic are both adversely affected. If the content of $Cu_xSb$ chemical compound is less than 0.09%, control of the Sb content in the contacts alloy is difficult, a uniform dispersion and distribution of the Sb constituent at the contact surface is not obtained, and the contact resistance characteristic and restriking characteristic are both adversely affected.

Yet further, in a vacuum interrupter that performs current interruption/conduction by opening/closure of contacts in vacuum, the contacts referred to above are manufactured of material constituted by, as anti-arcing constituent, in integrated form and size in the range 0.4 to 10 $\mu$m, Mo of mean grain size 0.4 to 9 $\mu$m and 50 to 75 weight % and W of mean grain size 0.4 to 9 $\mu$m and 0.001 to 5 weight % and as restriking stabilization auxiliary constituent, 0.09 to 1.4 weight % of $Cu_xSb$ chemical compound, and, as conductive constituent, Cu or CuSb alloy as the balance.

The presence of a prescribed small content of W (forming MoW in integrated form with Mo) improves the plastic deformation capability of Mo in regard to thermal or mechanical shock to which the W is subjected during circuit braking action or switching action, and thus has the benefit of suppressing chipping of Mo occurring at the contact surface in extremely minute, micro-scale portions. It therefore contributes to reduction of in particular the range of variability of the frequency of occurrence of restriking. If the W content exceeds 5 weight %, its benefit is lessened.

In another preferred mode of the present invention, the CuSb alloy referred to above contains in solid solution less than 0.5 weight % of Sb.

CuSb alloy containing more than 0.5 weight % of Sb in solid solution has severely impaired conductivity and cannot be utilized for contact material.

In another preferred mode of the present invention, the x in the chemical compound $Cu_xSb$ referred to above is x=1.9 to 5.5.

If the ratio x in regard to the Cu is outside the range 1.9 to 5.5, smoothness of the contact surface is difficult to obtain.

In another preferred mode of the present invention, the chemical compound $Cu_xSb$ referred to above may be any one or more selected from the group consisting of: $Cu_{5.5}Sb$, $Cu_{4.5}Sb$, $Cu_{3.65}Sb$, $Cu_{3\ 5}Sb$, $Cu_3Sb$, $Cu_{11}Sb_4$, or $Cu_2Sb$.

When indicating these modes, even after heating such as after the silver soldering step/after circuit breaking, the Sb constituent in the contacts is stable and readily remains behind in uniform fashion.

In another preferred mode of the present invention, the mean grain size (if the planar shape is circular, this is the diameter. If it is rectangular, ellipsoidal, or polygonal, it is the diameter calculated as of the circle of that area) of the chemical compound $Cu_xSb$ referred to above is of grain dimensions 0.02 to 20 $\mu$m.

If it is more than the 20 $\mu$m, the restriking characteristic is severely impaired and the contact resistance characteristic is also severely impaired. Base material wherein this is less than 0.02 $\mu$m is difficult to manufacture economically as a uniform base material. Furthermore, when portions wherein the mean grain size was under 0.02 $\mu$m were selected and evaluated, although their contact resistance characteristic showed no abnormality, there was severe variability of their restriking characteristic.

In another preferred mode of the present invention, the mean distance between grains of the chemical compound $Cu_xSb$ referred to above is highly dispersed, these being isolated by 0.2 to 300 $\mu$m.

Isolation of the chemical compound grains by less than 0.2 $\mu$m was difficult to achieve with contact manufacturing technology. If they are isolated by more than 300 $\mu$m, the $Cu_xSb$ chemical compound grains tend to aggregate and become of large size, making it difficult to achieve smoothness of the contact surface, due to exfoliation of the chemical compound grains. Also, there is severe variability of the frequency of restriking.

In another preferred mode of the present invention, the mean surface roughness (Rave.(=roughness average)) of the contact surfaces of the contacts referred to above is less than 10 $\mu$m, with a minimum value (Rmin.) of at least 0.05 $\mu$m.

If the mean surface roughness is more than 10 $\mu$m, severe variability of the contact resistance characteristic is seen. Obtaining a contact surface of surface roughness under 0.05 $\mu$m presents problems regarding productivity.

In another preferred mode of the present invention, a Cu layer having a thickness of at least 0.3 mm is applied to is the surface on the opposite side to the contact surface of the contacts referred to above.

This facilitates the operation of silver soldering with the electrode and/or conductive shaft.

In another preferred mode of the present invention, surface finishing is performed on the contact surface of the contacts described above by interrupting a current of 1 to 10 mA in a condition with a voltage of at least 10 kV applied.

In a range of 1 to 10 mA, the frequency of occurrence of restriking is greatly diminished. At under 1 mA, no benefit is found. If 10 mA is exceeded, surface irregularity is produced at the contact surface, which has the opposite effect of producing variability of the frequency of occurrence of restriking and variability of the contact resistance.

ACTION

General Conditions of Occurrence of Restriking in the Working Examples

In general, the arc tends to stagnate and concentrate in regions of low arc voltage. If current interruption is performed whilst applying a magnetic field (for example by the axial magnetic field technique) to the contact, the arc that is generated by the interruption moves over the contact electrode surface instead of stagnating and concentrating in regions of low arc voltage. Transient damage at the contact surface is thereby reduced, improving the interruption characteristic and contributing to a reduction in the probability of restriking. Specifically, since the arc easily moves over the contact electrode, dispersion of the arc is promoted; this is associated with a substantial increase in the area of the contact electrode that is involved in the process of current interruption, thereby contributing to an improvement in the current interruption characteristic. Furthermore, since stagnation and concentration of the arc are reduced, the benefits of prevention of local abnormal evaporation of the contact electrode and reduction of its surface roughness are obtained, contributing to reduction of the probability of restriking.

However, if current of more than a certain value is interrupted, the arc stagnates at one or more points, which cannot be predicted, on the contact surface, causing abnormal melting, and the current interruption limit is reached. Also, the abnormal melting induces instantaneous explosions or evaporation of the contact electrode material, and the metallic vapor that is thereby generated severely impairs insulation recovery of the vacuum circuit breaker in the contact separation step (during contact separation), further lowering the limit of interruption.

Furthermore, the abnormal melting produces giant molten drops, which produce roughness of the contact electrode surface, tending to lower its voltage withstanding ability, increase the probability of occurrence of restriking, and cause abnormal erosion or the material. It is desirable that the contact should be given surface conditions such that the locations of stagnation on the contact electrode surface of the arc which causes occurrence of these phenomena should be completely incapable of being predicted, as described above, and also that the arc generated should be moved and dispersed without stagnation.

Period of Occurrence of Restriking According to the Present Invention

Although, as described above, the mechanism of generation of the restriking phenomenon is not known, according to the experimental results of the inventors, restriking occurs with fairly high frequency between one contact and another contact within (inside) the vacuum interrupter, and between the contacts and the arc shield. Accordingly, the inventors were able to achieve a large reduction in the rate of occurrence of restriking by elucidating an extremely effective technique to suppress the generation of restriking by suppressing abrupt gas which is discharged when for example the contacts are subjected to arcing and by promoting optimization of the condition of the contact surface. According to the results of detailed analysis of the aforementioned simulated test of generation of restriking carried out by the inventors in respect of the occurrence of restriking, this was found to be related to cases directly influenced by the contact material, cases influenced by design aspects of the electrode construction and shield construction etc., and external mechanical/electrical conditions such as exposure to unanticipated high voltage. However, it is thought that the limit has been reached in respect of improvement of electrodes as aforementioned in regard to demands for higher voltage withstanding ability, larger current interruption capability, and further miniaturization that are being made in recent years, so some improvement/optimization other than these has become necessary.

As a result of simulated restriking tests conducted by the inventors involving appropriate mounting and removal within the vacuum interrupter of various structural members such as the ceramic insulating container sleeve, contacts, arc shield, metal covers, conductive rod, sealing metal, and bellows, they obtained the discovery that the composition of the contacts that are subjected to direct arcing, their material and condition, and the conditions of their manufacture are vitally important in regard to the rate of occurrence of restriking. In particular, they obtained the discovery that Cu—W or Cu—Mo, which are of high hardness and high melting point, are more advantageous than Cu—Bi, Cu—Te or Cu—Cr alloy, which are observed to display considerable discharge and dispersion of fine metallic particles into the inter-electrode space when subjected to shock as on power-up or interruption, due to the brittle nature of their materials. A further important observational discovery was that, even for the same Cu—W or Cu—Mo, there was variability in regard to the degree of occurrence of discharge and dispersion of fine metallic particles into the inter electrode space, and that, in particular, a high sintering temperature in the process of manufacturing Cu—W or Cu—Mo tended to be beneficial in suppressing occurrence of restriking.

Also, a characteristic feature in the observational results of the inventors regarding the relationship between the time of occurrence of restriking and the material condition of the Cu—W or Cu—Mo was that (a) the contacts composition and their condition (segregation/uniformity) was related to optimization of in particular the mixing conditions of the manufacturing process, and that restriking occurred randomly without regard to the number of times of previous current interruption/switching. (b) A further characteristic feature was that, although the quantity/condition of gas or moisture adhering to or absorbed on the contact surface is a problem of the storage environment (management environment) after processing of the previously finished contacts which does not directly concern sintering technique, restriking is seen from a comparatively early stage in terms of the number of times of current interruption/switching. (c) The importance of the manufacturing process is suggested by the fact that the quality of the raw-material powder (selection of Cu powder, W powder or Mo powder) and the mixing condition of the raw materials are important points in determining the contact interior conditions such as the condition and quantity of impurities incorporated in the interior of the contacts, and it is suggested that these are causes of restriking which occurs comparatively late in terms or number of times of current interruption.

Thus, although the time of occurrence of restriking is apparently unrelated to the history in terms of number of times of current interruption, it was found that the causes thereof differ depending on the time of occurrence as under (a), (b), (c). It is thought that this is an important reason for the manifestation of variability in the occurrence of restriking, between different vacuum interrupters, Action of the Alloy of the Present Invention An alloy according to the present invention is constituted by: W (WMo) or Mo (MoW) having the function of improving the mechanical erosion characteristic under interruption power-up operation or switching operation and anti-arcing performance (arc erosion) of the contacts as a whole; Cu (CuSb solid solution) having a function of maintaining a low and stable value of the contact resistance and ensuring conductivity of the contacts as a whole; Ca or CuSb solid solution produced by overheating of W (WMo) or Mo (MoW); and $Cu_xSb$ chemical compound that bears the function of acting as a restriking stabilization constituent, by mitigating transient evaporation loss of the $Cu_xSb$ chemical compound. The $Cu_xSb$ chemical compound functions effectively as a restriking stabilization constituent.

Action (1): in the alloy of the present invention, the content of W (WMo) or Mo (MoW) in the Cu—W alloy, and/or the grain size of W (WMo) or Mo (MoW) is optimized. Furthermore, micro-uniformity of the structure of the contact alloy as a whole is achieved by applying a restriction such that the size of the conductive constituent (Cu phase or CuSb solid solution) surrounded by the W (WMo) or Mo (MoW) is less than 50 $\mu$m or the size of less than 50 $\mu$m occupies at least a prescribed area. Furthermore, by controlling the grain size of the $Cu_xSb$ chemical compound to within a range of prescribed values (0.1 to 20 $\mu$m), and by controlling the mean distance between grains of the $Cu_xSb$ chemical compound to within a range of prescribed values (0.2 to 300 $\mu$m), the $Cu_xSb$ chemical compound is put into a highly dispersed condition and the extent of aggregation of $Cu_xSb$ chemical compound at the contact surface or of its exfoliation from the contact surface is reduced. As a result, the amount of $Cu_xSb$ chemical compound that is selectively and preferentially evaporated and dispersed on subjection to arcing is restricted to a minimum, the $Cu_xSb$ chemical compound grains are uniformly distributed at the contact surface, and $Cu_xSb$ chemical compound constituent in the form of a thin film is uniformly distributed at the contact surface.

Action (2): by controlling the mean grain size of the W (WMo) or Mo (MoW) in the alloy, and the mean grain size of $Cu_xSb$ chemical compound to practically the same level (size), dispersion and exfoliation of the W (WMo) or Mo (MoW) grains is reduced. Also, wettability between the Cu (CuSb solid solution) and w (WMo) or Mo (MoW) is improved, and adhesion between the W (WMo) or Mo (MoW) grains and Cu (CuSb solid solution) is improved. Furthermore, breaking away of $Cu_xSb$ chemical compound from the contact surface, which is extremely injurious in regard to occurrence of restriking, even under heat shock during arcing, is suppressed. As a result, stabilization of the restriking characteristic and contact resistance characteristic is achieved.

Action (3): thanks to the control of the condition in which W (WMo) or Mo (MoW) is present, uniformity of the alloy structure is achieved, so, even after arcing, a stable condition of the contact surface in regard to probability of restriking is obtained.

Action (4): as a modified example, it was found that the presence of Mo or W in Cu—W or Cu—Mo is beneficial in reducing discharge and dispersion of fine metallic particles into the inter-electrode space due to snock on power-up or interruption. Normally, on power-up or interruption, breaking-away is observed at the W or Mo surface, and some of this material may be dispersed or exfoliated. Thanks to the presence of Mo or W in the Cu—W or Cu—No, the bonding of the Cu and Mo or Cu and W is strengthened and the plastic deformation capability in extremely small areas is improved.

This is combined with the benefit of controlling the mean grain size of the $Cu_xSb$ chemical compound and the mean distance between grains referred to above to within prescribed values. As a result, the amount of exfoliated particles produced is itself reduced and even if some exfoliated particles still exist the benefit is obtained of applying a certain degree of rounding at the tips of the scars which they leave. As a result, the electric field concentration coefficient $\beta$, which expresses the contact surface condition, is improved from more than 100 to less than 100. This is beneficial in reducing discharge and dispersion of fine metallic particles into the inter-electrode space during interruption. It shows that the $Cu_xSb$ chemical compound functions effectively as a restriking stabilization constituent. As a result, generation of fine metallic particles by shock on power up or interruption is suppressed to a low level and the amounts of these which are discharged and dispersed become small, contributing to suppression of restriking and contributing to stabilization of the contact resistance characteristic. In this way, they can be simultaneously obtained the benefit of $Cu_xSb$ chemical compound referred to above having optimized mean grain size and mean distance between the grains, the advantage of improvement of the electric field concentration coefficient β due to the W (WMo) or Mo (MoW), and a stable contact resistance characteristic and restriking characteristic.

Due to the synergetic effect of these desired actions, with the $Cu_xSb$ chemical compound in this alloy, while maintaining the current interruption characteristic, a table contact resistance characteristic of the Cu—W or Cu—Mo alloy and suppression of the rate of occurrence of restriking are obtained.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 1 is a table showing the conditions of working examples 1 to 29, given in explanation of a first embodiment of a vacuum interrupter according to the present invention and comparative examples 1 to 13;

FIG. 2 is a table showing the conditions of working examples 1 to 29, given in explanation of a first embodiment of a vacuum interrupter according to the present invention and comparative examples 1 to 13;

FIG. 4 is a table showing the conditions of working examples 30 to 58, given in explanation of a second embodiment of a vacuum interrupter according to the present invention and comparative examples 14 to 26.

FIGS. 1–4 each contain 4 sheets in sequence. Thus, FIGS. 1–4 are represented by a total of 16 sheets, wherein in sequence sheets 1–4 correspond to FIG. 1, sheets 4–8 correspond to FIG. 2, sheets 9–12 correspond to FIG. 3 and sheets 13–16 corresponding to; FIG. 4

DETAILED DESCRIPTION OF THE PREFERRED EMBODIMENTS

Figure 3D:
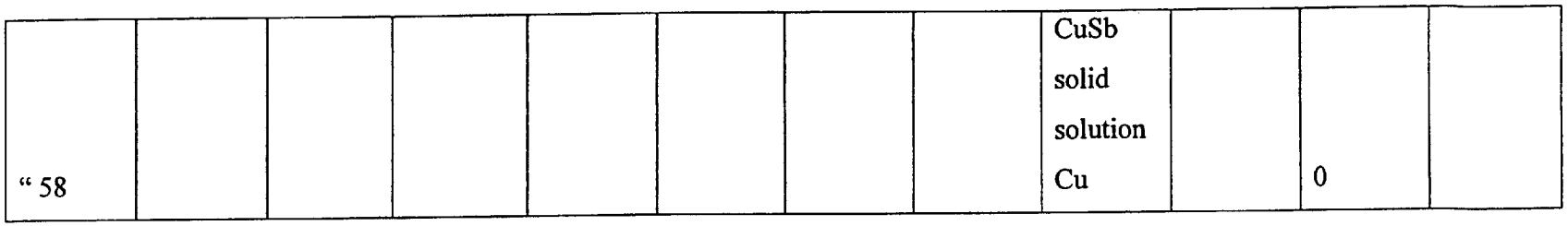
FIG. 3 is a table showing the conditions of working examples 30 to 58, given in explanation of a second embodiment of a vacuum interrupter according to the present invention and comparative examples 14 to 26.

Referring now to the drawings, wherein like reference numerals designate identical or corresponding parts throughout the several views, and more particularly to FIG. 1 thereof, one embodiment of the present invention will be described.

The essence of a first embodiment of the present invention consists in a contact material constituted, in a vacuum interrupter in which Cu—W based contacts are mounted, by prescribed amounts of W (WMo), $Cu_xSb$ chemical compound, and Co (CuSb solid solution), in order to suppress and reduce occurrence of restriking of the vacuum interrupter and to stabilize the contact resistance, the effect being obtained by optimal management of the contents, size and condition of the constituents. The vital point is therefore the control of the contents, size and condition (grain size and/or mean distance between grains) of the constituents.

Next, evaluation conditions and methods of evaluation etc. clarifying the benefits of this embodiment will be indicated.

(1) Restriking Characteristic

Disc-shaped contacts of diameter 30 mm, thickness 5 mm, arranged to be brought into contact facing each other, their contacting faces being finished with mean surface roughness 10 μm, one of these being of radius of curvature 250 mm, While the other is flat were mounted in a demountable type vacuum interrupter, and the frequency of occurrence of restriking was measured on interrupting a circuit of 6 kV×500 A 20,000 times. When mounting the contacts, only baking (450° C.×30 minutes) was performed; use of solder and the concomitant heating was not performed.

(2) Contact Resistance Characteristic

The contact resistance immediately after mounting the above contacts in a demountable vacuum interrupter was found in a condition with a load of 1 kg applied between these two, the voltage drop between the contacting surfaces being found in a condition with 24 V×110 A applied thereto, and the contact resistance (x) of a new product (prior to the test) was calculated. Furthermore, immediately after completion of the restriking test described above in which a circuit of 6 kV×500 A was interrupted 20,000 times, the contact resistance (y) after the test was calculated by finding the potential drop under the same voltage/current conditions as mentioned above.

However, with the contact material of this example, even for a new product, the contact resistance varied in the range 30 to 200 μΩ depending on the conditions of the contact and/or the condition of finishing processing. Accordingly, the contact resistance characteristic was evaluated in terms of the ratio of that prior to the test and that after the test. The (y/x) value shown in the table of FIG. 1 as the contact resistance characteristic indicates by what factor the contact resistance value (y) after the test has changed with respect to the contact resistance value (x) of a new product.

(3) Example of Method of Manufacturing Contacts

When manufacturing [Cu—W—$Cu_xSb$] alloy, the following five methods may be selectively applied industrially.

According to the first method, first of all $Cu_xSb$ chemical compound is manufactured beforehand, and this $Cu_xSb$ chemical compound is then pulverized to manufacture $Cu_xSb$ chemical compound powder. Next, Cu powder (or CuSb solid solution powder), W powder, and $Cu_xSb$ chemical compound powder, respectively, are weighed out in prescribed amounts, thoroughly mixed, and molded and sintered under applied pressure of for example 4 ton/cm$^2$ to produce contact blanks.

In a second method, first of all a (CuW) skeleton, a (CuSb solid solution W) skeleton, and a (W) skeleton prepared with prescribed porosities are manufactured at for example 1200° C. Separately, $Cu_xSb$ chemical compound and CuSb alloy are manufactured. Contact blanks are then produced by infiltrating the Sb constituent (the aforementioned $Cu_xSb$ chemical compound or CuSb alloy) and Cu constituent into the prescribed voids of any of these skeletons, at for example 1150° C.

In the third method, since the content of $Cu_xSb$ chemical compound in the Cu—W alloy is enormously smaller than the (Cu+W) content, it is necessary to achieve uniform mixture of the $Cu_xSb$ chemical compound in the alloy. As a means of achieving this, for example some or all of the $Cu_xSb$ chemical compound content which will be finally necessary is mixed with practically the same volume of W (if necessary with addition of Cu) to obtain a primary mixed powder (if necessary, this may be repeated up to an nth mixture).

This primary mixed powder (or nth mixed powder) and the remaining W powder are again mixed to produce finally (W+$Cu_xSb$ chemical compound) mixed powder in a thoroughly satisfactorily mixed condition. This (W+$Cu_xSb$ chemical compound) mixed powder and a prescribed quantity of Cu powder are mixed and then subjected to sintering and pressurization at for example a temperature of 1060° C. in a hydrogen atmosphere (vacuum is also possible), once or a plurality of times, to manufacture Cu—W—$Cu_xSb$ contact blanks, which are then used to make contacts by processing to the prescribed shape.

Also, some or all of the $Cu_xSb$ chemical compound content which will be finally necessary is mixed with practically the same volume of Cu (if necessary with addition of W) to obtain a primary mixed powder (if necessary, this may be repeated up to an nth mixture).

This primary mixed powder (or nth mixed powder) and the remaining Cu powder are again mixed to produce finally (Cu+$Cu_xSb$ chemical compound) mixed powder in a thoroughly satisfactorily mixed condition. This (Cu+$Cu_xSb$ chemical compound) mixed powder and a prescribed quantity of W powder re mixed and then subjected to sintering and pressurization at for example a temperature of 1060° C. in a hydrogen atmosphere (vacuum is also possible), once or a plurality of times, to manufacture {Cu—W—$Cu_xSb$} contact blanks, which are then used to make contacts by processing to the prescribed shape.

The fourth method is a physical method using an ion plating device or sputtering device or a mechanical method using a ball mill; W powder is obtained by coating the surface of W powder with $Cu_xSb$ chemical compound, and this $Cu_xSb$ chemical compound-coated W powder and Cu powder are mixed and {Cu—W—$Cu_xSb$} contact blanks are then manufactured by combining, once or a plurality of times, sintering and pressurization at a temperature of for example 1060° C., in a hydrogen atmosphere (vacuum is also possible).

In the fifth method, in the technique of uniformly mixing in particular Cu powder, W powder and $Cu_xSb$ chemical compound powder, a method in which rocking vibration and mixing are superimposed is advantageous. By this means, the phenomenon of formation of lumps or aggregates, which is found when solvents such as the commonly-used acetone are employed with mixed powder is eliminated, improving ease of working.

Also, if the ratio R/S of the number of times of mixing R of the mixing movement of the mixing container in the mixing operation and the number of times S of rocking of the rocking vibration applied to the mixing container is selected in a preferred range of approximately 10 to 0.1, a preferred range of energy input to the powder during crushing, dispersion and mixing is achieved, resulting in the characteristic feature that the extent of denaturing of the powder or the degree of contamination thereof in the mixing operation can be kept low.

Although a crushing action is applied to the powder in mixing and pulverization using a conventional mixer, with the present method, in which rocking vibration and mixing movement are superimposed, the aforesaid R/S ratio being distributed at about 10 to 0.1, mixing is produced to the extent that the powders become intimately entangled with each other, thereby achieving good permeability and so improving sintering characteristics and enabling an excellent molding, sintered body or skeleton to be obtained. Furthermore, since there is no energy input beyond what is needed, denaturing of the powder cannot occur. If such a mixed powder is used as raw material, low gas evolution from the alloy after sintering and infiltration can be achieved, contributing to stabilization of the restriking characteristic.

Next, a second embodiment of the present invention will be described in detail with reference to working examples.

Working Examples 1 to 3

First of all, an outline of assembly of a test valve for interruption tests will be described. A ceramic insulated container (chief constituent: $Al_2O_3$) was prepared, with the mean end-face surface roughness ground to about 1.5 μm; preheating treatment of this ceramic insulated container at 1650° C. was performed prior to assembly.

As sealing metal, 42 weight % Ni—Fe alloy of sheet thickness 2 mm was employed.

As soldering material, 72 weight % Ag—Cu alloy of thickness 0.1 mm was employed.

Members prepared as above were arranged so as to be capable of effecting vacuum sealing joining between the items to be joined (end face of the ceramic insulated container and sealing metal), and supplied to a vacuum sealing step of the sealing metal and ceramic insulated container in a vacuum atmosphere of $5\times10^{-4}$ Pa.

Next, details of the test contact materials and evaluation details and results etc. will be described.

For the {Cu—W—$Cu_xSb$-balance Cu} alloy (x=2), W of mean grain size 1.5 μm was prepared as raw material powder, and contact blanks of {60 to 92 weight % W—$Cu_xSb$ balance Cu} were prepared by suitable selection of the above first to fifth methods of manufacture. These blanks were processed to contact test pieces of prescribed shape and finished to a surface thickness of the contact surfaces of 2 μm to be employed as test pieces. Their details are shown in the table of FIG. 1, while the evaluation conditions and results are shown in the table of FIG. 2.

First of all, the restriking characteristic and contact resistance characteristic of the {75 weight % W—$Cu_2Sb$ balance Cu} alloy shown in working example 2 of the table of FIG. 1 were measured, these values being taken as standard values.

In contrast, in the case of the alloy {60 weight % W—$Cu_2Sb$-balance Cu} of comparative example 1, the restriking characteristic when a 6 kV×500 A circuit was interrupted 20,000 times showed the high frequency of occurrence and variability of restriking of 1.34 to 2.16% i.e. it was much worse than the case of the standard working example 2 of {75 weight % W—$Cu_2Sb$-balance Cu} alloy and so was undesirable.

Regarding the contact resistance characteristic after measurement of the restriking characteristic, in working example 1, due to the effect of the Cu content in the alloy, this was approximately halved (42.4 to 61.8), taking the value in the case of working example 1 as 100 i.e. it exhibited in most regions a low and stable contact resistance characteristic.

In contrast, in the case of alloy of W content {65 weight % W—$Cu_2Sb$-balance Cu} as in working example 1 and the alloy {85 weight % W—$Cu_2Sb$-balance Cu} as in working example 3, restriking frequencies of occurrence in the allowed ranges of 0.96 to 0.99 and 0.93 to 0.95 were displayed. The contact resistance ranges shown were 100.1 to 128, and 118.6 to 142.5, which present no practical problems, taking the value of practical example 2 as 100.

In contrast, in the case of the alloy {92 weight % W—Cu,Sb-balance Cu} of comparative example 2, although a stable frequency of occurrence of restriking and variability characteristic in the range 0.91 to 0.94 was displayed, the contact resistance was extremely high at 719 to 1634, and showed large variability, to the extent that this could not be practically used. In addition, in a further test, it was found that the temperature rise during conduction was high. It was found that interruption of 500 A produced local tortoise shell-shaped cracks by overheating at the contact surfaces. Generation of enormous cracks and partial exfoliation thereof at the interruption surface were seen. Although the restriking characteristic was in the desired range, the contact resistance was, in some places, very high, caused chiefly by deterioration of conductivity and occurrence of Joule heating, due to insufficiency of the Cu content.

Thus, in the case of the alloy {60 weight % W—$Cu_2Sb$ balance Cu} of comparative example 1, frequent occurrence of restriking and a considerable increase in the contact resistance are seen, and, in the case of the alloy {92 weight % W—$Cu_2Sb$-balance Cu} of comparative example 2, a further large increase in contact resistance is seen; these are therefore undesirable. It was found that, in accordance with the object of the present invention, overall stability was shown when the W content was in the range 65 to 85 weight % (working examples 1 to 3).

Working Examples 4 to 7

In the working examples 1 to 3 described above, the benefits were illustrated where the Mo content in the alloy {W—$Cu_xSb$-balance Cu} is 0 (zero), but the benefits of the present invention are not displayed solely in this case.

Specifically, when the Mo content was made 0.001 to 5% in the alloy {75 weight % W—$Cu_2Sb$-balance Cu}, relative values of 0.94 to 0.98 were displayed, taking the restriking characteristic of working example 2 as 1.00 i.e. a restriking characteristic of the same stability as the characteristic of the standard working example 2 was displayed. Also, taking the contact resistance of working example 2 as 100, relative values of 95.4 to 159.6 were displayed i.e. a contact resistance characteristic of the same stability as the characteristic of the standard working example 2 was displayed.

On observation of the contact surface, it is found that the presence of a prescribed content of Mo tends to suppress, to a certain degree, chipping of W. However, in the case of comparative example 3, where the Mo content was 12%, a restriking characteristic of 0.96 to 1.36 was displayed, which is undesirable, and more frequent occurrence of restriking and larger variability than in the case of the characteristic of working example 2 which was taken as standard are seen, which is also undesirable. Also, contact resistance values of 128.7 to 273.2 are displayed and there is larger variability than in the case of working example 2 which was taken as standard; this is therefore undesirable. Also, in observations of the contact surface, the benefit in terms of suppression of chipping of W was found to be small. Integrated grains of WMo were found to be in a compositionally segregated condition. When such segregation is present, variability of the restriking characteristic and contact resistance tended to occur. It was therefore judged that overall stability was displayed in a range of Mo content of 0.001 to 5% as shown in working examples 4 to 7 of the table of FIG. 1.

Working Examples 8 to 9

In working examples 1 to 3 and comparative examples 1 to 2 described above, the benefits were described when the W content in the alloy {W—$Cu_2Sb$-balance Cu} was 60 to 92 weight %, the mean grain size of the W being 1.5 $\mu$m, and also in the case where, in working examples 4 to 7 and comparative example 3, the Mo content in the {WMo—$Cu_xSb$ balance Cu} alloy was 0.001 to 12 weight %, the mean grain size of the WMo integrated grains being 1.5 $\mu$m. However, the benefits of the present invention are not displayed solely when the mean grain size is restricted to 1.5 $\mu$m.

Specifically, when, as in the working examples 8 to 9 of the table of FIG. 1, {75 weight % W—$Cu_2Sb$-balance Cu} alloy is employed in which the Mo content is 0 and the W content is 75 weight %, even though the mean grain size was 0.4 $\mu$m to 9 $\mu$m, relative values of the rate of occurrence of restriking of 0.88 to 1.02 were displayed, i.e. a characteristic was displayed of the same stability as the characteristic of the standard working example 2.

Regarding the contact resistance percentage multiple also, relative values of 95.2 to 138.2 were displayed, taking working example 2 as 100; this is a substantially desirable range.

In contrast, when the mean grain size of the w was made 0.1 $\mu$m (comparative example 4), although the contact resistance percentage multiple was in the very desirable range of 90.5 to 99.6, the restriking rate of occurrence was 2.66 to 3.18 i.e. there was a severe deterioration of the restriking characteristic from the characteristic of the standard working example 2; this was therefore undesirable. The reasons for this are believed to be that, when the gas content of the contact blanks was examined it was found that this had not been fully removed and residual gas was left, caused by the fact that the mean grain size of the W that was used was extremely fine at 0.1 $\mu$m; it is thought that this influenced in particular the frequent occurrence of restriking.

Also, the rate of occurrence of restriking when the mean grain size was comparatively coarse at 15 $\mu$m showed the relative values of 3.42 to 6.28 (times) i.e. it displayed considerable variability in comparison with the characteristic of working example 2 which was taken as standard; thus it displayed a characteristic which was inferior in regard to stability. The contact resistance percentage multiple also showed relative values of 118 to 784 times, taking that of working example 2 as 100 i.e. it showed a substantially undesirable range (comparative examples 4 to 5). It should be noted that, owing to the frequent occurrence of restriking, evaluation was not made for the prescribed 20,000 times, but was discontinued at 2000 times. The gas content in the contact blanks was much larger.

Practical Examples 10 to 15

In regard to the auxiliary constituent in the alloy {W—$Cu_xSb$-balance Cu}, working examples 1 to 9 described above were indicated in terms of the effect when x=2, but the benefits of the present invention are not shown solely when this is the case.

Specifically, when x in the auxiliary constituent $Cu_xSb$ was taken as 1.9 to 5.5, as in the case of working examples 10 to 15 of the table of FIG. 1, relative values of 0.98 to 1.04 times were obtained, taking the restriking characteristic of working example 2 as 1.00 i.e. restriking characteristics were obtained of the same stability as the restriking characteristic of working example 2, which was taken as standard. Taking the contact resistance of working example 2 as 100, relative values of 95.4 to 124.1 times were displayed i.e. a contact resistance characteristic of the same stability as the characteristic of the standard working example 2 was displayed.

In contrast, where, as in the case of comparative example 6, x in $Cu_xSb$ W was less than 1.9, although the contact resistance percentage multiple was in the range 98.0 to 124.1 i.e. represented an equivalent characteristic to that of the working example 2 which was taken as standard, the percentage multiple of occurrence of restriking showed values of 0.98 to 4.18 i.e. it showed large variability in comparison with the characteristic of the standard working example 2; this was therefore undesirable.

The reason for this is that if x in $Cu_xSb$ W is less than 1.9, the Sb distribution cannot be fully uniformly dispersed, so, depending on the location, wide regions exist in which Sb is not present (segregation of Sb).

From the above, it was concluded that x in the alloy {W—$Cu_xSb$—Cu} is preferably in the range x=2.75 to 5.5.

Working Examples 16 to 18

Although, in working examples 1 to 15 described above, he benefits were indicated when the content of auxiliary constituent $Cu_xSb$ in the alloy {W—$Cu_xSb$-balance Cu} was 0.11 weights, the benefits of the present invention are not shown solely when this is the case.

Specifically, as shown in working examples 16 to 18 of the table of FIG. 1, when the content of $Cu_xSb$ is made 0.09 to 1.4%, relative values of 0.94 to 1.01 times are displayed, taking the restriking characteristic of working example 2 as 1.00 i.e. a restriking characteristic is displayed of the same stability as the restriking characteristic of the standard working example 2. Taking the contact resistance of working example 2 as 100, relative values of 99.7 to 146.6 times are displayed i.e. a contact resistance characteristic of the same stability as the characteristic of working example 2, which is taken as standard, is displayed.

On the other hand, when, as in the case of comparative example 7, x in $Cu_xSb$ is made 0.03%, relative values of 90.0 to 95.9 times are displayed, taking the contact resistance of working example 2 as 100 i.e. a contact resistance characteristic is displayed which is of the same stability as the characteristic of working example 2, which is taken as standard. However, taking the restriking characteristic of working example 2 as 1.00, a restriking percentage multiple of 0.31 to 3.36 times is displayed i.e. severe variability is displayed in comparison with the characteristic of working example 2, which is taken as standard. The reason is that, due to technical reasons during the manufacture of the alloy, it was not possible to obtain economically an alloy in which the $Cu_xSb$ was fully uniformly dispersed.

Furthermore, when, as in the case of comparative example 8, x in the $Cu_xSb$ was made 2.3%, taking the contact resistance of working example 2 as 100, relative values of 181.5 to 446.0 times were displayed i.e. a contact resistance characteristic of severe variability in comparison with the characteristic of working example 2 which was taken as standard is displayed. Also, in this example, taking the restriking characteristic of working example 2 as 1.00, a restriking percentage multiple of 2.02 to 6.62 times was displayed i.e. severe variability was displayed in comparison with the characteristic of working example 2, which was taken as standard. This was due to the silver soldering tending to be poor, due to excess $Cu_xSb$ content, and to it not being possible to obtain economically an alloy in which the $Cu_xSb$ was uniformly dispersed.

From the above, it was concluded that the content of auxiliary constituent $Cu_xSb$ in the {W—$Cu_xSb$—Cu} alloy should preferably be in the range 0.09 to 1.4 weight %.

Working Examples 19 to 20

Although, in the working examples 1 to 18 described above, the benefits were illustrated in the case where the size of the auxiliary constituent $Cu_xSb$ grains in the {W $Cu_xSb$-balance Cu} alloy was 7 $\mu$m, the benefits of the present invention are not solely manifested where this is the case.

Specifically, as shown in working examples 19 to 20 of the table of FIG. 1, when the size of the $Cu_xSb$ grains was made 0.02 to 20 $\mu$m, taking the restriking characteristic of working example 2 as 1.00, relative values of 0.94 to 0.99 times were displayed i.e. a restriking characteristic of the same stability as the characteristic of working example 2, which was taken as standard, was displayed. Regarding the contact resistance characteristic also, taking the contact resistance of working example 2 as 100, relative values of 97.1 to 124.8 times were displayed i.e. a contact resistance characteristic was displayed of same stability as the characteristic of working example 2, taken as standard.

In contrast, as shown in comparative example 9, if the size of the auxiliary constituent $Cu_xSb$ grains was made less than 0.02 $\mu$m, taking the contact resistance of working example 2 as 100, the test was discontinued and excluded from the effective range, since it was difficult to mass produce contact blanks having a structure in which the $Cu_xSb$ grains were uniformly dispersed at the micro level.

Furthermore, as shown in comparative example 10, if the size of the $Cu_xSb$ grains is taken as 34 $\mu$m, taking the contact resistance of working example 2 as 100, relative values of 216.3 to 417.1 times are displayed i.e. the contact resistance characteristic showed severe deterioration and large variability compared with the characteristic of working example 2 taken as standard. Also, taking the restriking characteristic of working example 2 as 1.00, restriking percentage multiples of 0.99 to 2.46 times are displayed, representing considerable variability in comparison with the characteristic of working example 2 taken as standard.

The reasons for this are: due to the presence of coarse $Cu_xSb$ grains of large contact resistance, the problem of the probability of the contact point being located exactly above one of these coarse $Cu_xSb$ grains, resulting in large variability of the contact resistance being displayed; poor silver soldering tending to occur due to the large content of $Cu_xSb$ grains which are of poor joining characteristics; and it not being possible to obtain economically an alloy in which the $Cu_xSb$ is sufficiently uniformly dispersed.

For these reasons, it is preferable that the size of the auxiliary constituent $Cu_xSb$ in the {W—$Cu_xSb$—Cu} should be in the range 0.02 to 20.0%.

Working Examples 21 to 24

In working examples 1 to 20 described above, the benefits were described of the case where the mean distance between grains of the auxiliary constituent $Cu_xSb$ grains in the {W—$Cu_xSb$-balance Cu} alloy was 25 $\mu$m, but the benefits of the present invention are not shown solely in this case.

Specifically, if the mean distance between grains of $Cu_xSb$ grains of working examples 21 to 24 of the table of FIG. 1 is taken as 0.2 to 300 μm, taking the restriking characteristic of working example 2 as 1.00, relative values of 0.98 to 1.24 times are displayed i.e. a restriking characteristic is displayed which is of the same stability as the characteristic of working example 2, taken as standard. Also in the case of the contact resistance characteristic, if the contact resistance of working example 2 is taken as 100, relative values of 95.3 to 144.7 times are displayed i.e. a contact resistance characteristic of the same stability as the characteristic of working example 2 taken as standard is displayed.

In contrast, as shown in comparative example 11, if the mean distance between grains of the auxiliary $Cu_xSb$ grains was made less than 0.2 μm, just as in the case of comparative example 9 described above, i.e. when the mean distance between $Cu_xSb$ grains was made less than 0.2 μm, the test was discontinued and excluded from the effective range of invention, since it was difficult to mass produce contact blanks having a structure in which these were uniformly dispersed at the micro level.

Furthermore, when, as in comparative example 11, the mean distance between grains of the $Cu_xSb$ grains was made 600 μm, taking the restriking characteristic of working example 2 as 1.00, a restriking percentage multiple of 2.16 to 5.58 times was displayed i.e., compared with the characteristic of working example 2 which was taken as standard, severe deterioration and large variability were displayed.

Also, taking the contact resistance of working example 2 as 100, relative values of 128.7 to 275.5 times are displayed i.e. a contact resistance characteristic which is markedly inferior and shows considerable variability is displayed, compared with the characteristic of working example 2 which was taken as standard.

Since the distance between adjacent grains of the $Cu_xSb$, which are of high contact resistance is made large, the distance between Cu phase or $Cu_xSb$ alloy phase, which is of comparatively low contact resistance, also becomes large; consequently, a coarse structural condition is produced, in which there is large variability of contact resistance, depending on the position of the contact point. Regarding the restriking characteristic also, similar variability is displayed, dependent on the position of the cathode spot, due to the coarse structural condition; thus, the restriking value also shows considerable variability.

From the above, it is desirable that the mean distance between grains of the auxiliary constituent $Cu_xSb$ in the {W—$Cu_xSb$—Cu} alloy should be in the range 0.2 to 300 μm.

Working Examples 25 to 27

In working examples 1 to 24 described above, the benefits were described of the case where the content of Sb (content of Sb in solid solution in the CuSb solid solution) in the conductive constituent in the {W—$Cu_xSb$-balance Cu} alloy was 0.01 weight %, but the benefits of the present invention are not restricted to this case.

Specifically, as shown in working examples 25 to 27 of the table of FIG. 1, when the Sb content in the conductive constituent was made 0.004 to 0.5 μm, taking the restriking characteristic of working example 2 as 1.00, relative values of 0.90 to 1.02 times were displayed i.e. a restriking characteristic of the same stability as the characteristic of working example 2 which was taken as standard is displayed. Regarding the contact resistance characteristic also, taking the contact resistance of working example 2 as 100, relative values of 96.3 to 145.5 times were displayed i.e. a contact resistance characteristic of the same stability as the characteristic of working example 2 taken as standard was displayed.

However, when, as in the case of comparative example 13, the content of Sb in the conductive constituent was made more than 0.5 μm, taking the restriking characteristic of working example 2 as 1.00, restriking percentage multiples of 1.00 to 2.24 times were displayed; thus it will be seen that this was inferior to the characteristic of working example 2, which was taken as standard. Also, in this comparative example 13, taking the contact resistance of working example 2 as 100, relative values of 392.4 to 617.7 times were displayed i.e. considerable deterioration and large variability of contact resistance characteristic were displayed compared with the characteristic of working example 2, which was taken as standard.

Working Examples 28 and 29

In working examples 1 to 27 described above, the benefits when CuSb solid solution was employed as the conductive constituent in {W—$Cu_xSb$-balance Cu} alloy were illustrated, but the benefits of the present invention are not restricted to this case.

Specifically, in both the case where the conductive constituent is {Cu+CuSb solid solution) and where it is {Cu}, taking the restriking characteristic of working example 2 as 1.00, relative values of 0.96 to 0.99 times are displayed i.e. a restriking characteristic of the same stability as the characteristic of working example 2 taken as standard is obtained. Regarding the contact resistance characteristic also, taking the contact resistance of working example 2 as 100, relative values of 90.8 to 123.3 times are displayed i.e. a contact resistance characteristic of the same stability as working example 2 taken as standard are displayed.

It should be noted that, although, in the above working examples 1 to 29, the benefits in terms of restriking characteristic and contact resistance characteristic when the surface roughness (Rave.) of the contact surfaces after manufacture of the {W—$Cu_xSb$-balance Cu} alloy was made to be 2 μm were illustrated, the benefits of the present invention are not restricted to this case.

Specifically, even when the mean surface roughness (Rave.) is made less than 10 μm, down to a minimum value (Rmin.) of more than 0.05 μm, a contact resistance characteristic of the same stability as the characteristic of working example 2 taken as standard is displayed.

Although, in the above working examples 1 to 29, the benefits in terms of restriking characteristic and contact resistance characteristic when the electrical circuit was constituted by direct silver soldering of {W—$Cu_xSb$ balance Cu} alloy on the electrode or conductive rod were illustrated, the benefits of the present invention are not manifested solely in this case.

Specifically, even when silver solderability is improved by applying a Cu layer having a thickness of at least 0.3 mm to the faces of the {W—$Cu_xSb$-balance Cu} alloy other than the contact surface, restriking characteristics and contact resistance characteristics of the same stability as the characteristics of working example 2, which was taken as standard, are displayed.

In the above working examples 1 to 29, the benefits in terms of the restriking characteristic and contact resistance characteristic when the surface roughness (Rave.) of the contact surface was made to be 2 μm after manufacture of the {W—$Cu_xSb$-balance Cu} alloy were indicated, but an even more stable restriking characteristic and contact resistance characteristic can be obtained by surface finishing performed by interrupting of currents of 1 to 10 mA in a condition with at least 10 kV applied, at the contact surface formed by the {W—$Cu_xSb$-balance Cu} alloy.

A second embodiment of a vacuum interrupter according to the present invention is described below.

In a vacuum interrupter in which are mounted Cu—Mo-based contacts, the essence of the second embodiment of the present invention consists in contact material wherein benefits are obtained by optimal management of the content, size and condition of the constituents, by constituting it of a prescribed amount of Mo (or MoW), $Cu_xSb$ chemical compound, and Cu (CuSb solid solution), in order to suppress and reduce occurrence of the restriking phenomenon of the vacuum interrupter and to stabilize the contact resistance. Control of the content, size and condition (grain size and/or mean distance between grains) of the constituents is therefore the vital point.

The evaluation in order to elucidate the benefits of this embodiment is carried out in terms of restriking characteristic and contact resistance characteristic and is the same as that of the preceding embodiment given on pages 24–25, to which the reader is referred.

Next, an example of a method of manufacturing Cu—Mo contacts will be described.

When manufacturing [Mo—$Cu_xSb$—Cu] alloy, the following five methods may be selectively applied industrially.

According to the first method, first of all $Cu_xSb$ chemical compound is beforehand manufactured, and this $Cu_xSb$ chemical compound is then pulverized to manufacture $Cu_xSb$ chemical compound powder. Next, Cu powder (or CuSb solid solution powder), Mo powder, and $Cu_xSb$ chemical compound powder, respectively, are weighed out in prescribed amounts, thoroughly mixed, and molded and sintered under applied pressure of for example 4 ton/cm$^2$ to produce contact blanks.

In the second method, first of all a (MoCu) skeleton, a (Mo—CuSb solid solution) skeleton, and a (Mo) skeleton prepared with prescribed porosities are beforehand manufactured at for example 1200° C. Separately, $Cu_xSb$ chemical compound and CuSb alloy are manufactured. Contact blanks are then produced by infiltrating the Sb constituent (the aforementioned $Cu_xSb$ chemical compound or CuSb alloy) and Cu constituent into the prescribed voids of any of these skeletons, at for example 1150° C.

In the third method, since the content of $Cu_xSb$ chemical compound in the Cu—Mo alloy is enormously smaller than the (Cu+Mo) content, it is necessary to achieve uniform mixture of the $Cu_xSb$ chemical compound in the alloy. As a means of achieving this, for example some or all of the $Cu_xSb$ chemical compound content which will be finally necessary is mixed with practically the same volume of Mo (if necessary with addition of Cu) to obtain a primary mixed powder (if necessary, this may be repeated up to an nth mixture).

This primary mixed powder (or nth mixed powder) and the remaining Mo powder are again mixed to produce finally (Mo+$Cu_xSb$ chemical compound) mixed powder in a thoroughly satisfactorily mixed condition. This (Mo+$Cu_xSb$ chemical compound) mixed powder and a prescribed quantity of Cu powder are mixed and then subjected to sintering and pressurization at for example a temperature of 1060° C. in a hydrogen atmosphere (vacuum is also possible), once or a plurality of times, to manufacture {Mo—$Cu_xSb$—Cu} contact blanks, which are then used to make contacts by processing to the prescribed shape.

Also, some or all of the $Cu_xSb$ chemical compound content which will be finally necessary is mixed with practically the same volume of Cu (if necessary with addition of Mo) to obtain a primary mixed powder (if necessary, this may be repeated up to an nth mixture).

This primary mixed powder (or nth mixed powder) and the remaining Cu powder are again mixed to produce finally (Cu+$Cu_xSb$ chemical compound) mixed powder in a thoroughly satisfactorily mixed condition. This (Cu—$Cu_xSb$ chemical compound) mixed powder and a prescribed quantity of Mo powder are mixed and then subjected to sintering and pressurization at for example a temperature of 1060° C. in a hydrogen atmosphere (vacuum is also possible), once or a plurality of times, to manufacture {Mo—$Cu_xSb$—Cu) contact blanks, which are then used to make contacts by processing to the prescribed shape.

The fourth method is a physical method using an ion plating device or sputtering device or a mechanical method using a ball mill; Mo powder is obtained by coating the surface of Mo powder with $Cu_xSb$ chemical compound, and this $Cu_xSb$ chemical compound-coated w powder and Cu powder are mixed and {Mo—$Cu_xSb$—Cu} contact blanks are then manufactured by combining, once or a plurality of times, sintering and pressurization at a temperature of for example 1060° C., in a hydrogen atmosphere (vacuum is also possible).

In the fifth method, in the technique of uniformly mixing in particular Cu powder, Mo powder and $Cu_xSb$ chemical compound powder, a method in which rocking vibration and mixing are superimposed is advantageous. By this means, the phenomenon of formation of lumps or aggregates, which is found when solvents such as the commonly-used acetone are employed with mixed powder is eliminated, improving ease of working.

Also, if the ratio R/S of the number of times of mixing R of the mixing movement of the mixing container in the mixing operation and the number of times S of rocking of the rocking vibration applied to the mixing container is selected in a preferred range of approximately 10 to 0.1, a preferred range of energy input to the powder during crushing, dispersion and mixing is achieved, resulting in the characteristic feature that the extent of denaturing of the powder or the degree of contamination thereof in the mixing operation can be kept low.

Although a crushing action is applied to the powder in mixing and pulverization using a conventional mixer, with the present method, in which rocking vibration and mixing movement are superimposed, the beforementioned R/S ratio being distributed at about 10 to 0.1, mixing is produced to the extent that the powders become intimately entangled with each other, thereby achieving good permeability and so improving sintering characteristics and enabling an excellent molding, sintered body or skeleton to be obtained.

Furthermore, since there is no energy input beyond what is needed, denaturing of the powder cannot occur. If such a mixed powder is used as raw material, low gas evolution from the alloy after sintering and infiltration can be achieved, contributing to stabilization of the restriking characteristic.

Next, the second embodiment of the present invention is described in detail with reference to the working examples indicated below.

Working Examples 30 to 32

First of all, the restriking characteristic and contact resistance characteristic of the {60 weight % Mo—$Cu_2Sb$-balance Cu} alloy shown in working example 31 of the table of FIG. 3 were likewise measured, these values being taken as standard values.

In contrast, in the case of the alloy (44 weight % Mo-$Cu_2Sb$-balance Cu} of comparative example 14, the restriking characteristic when a 6 kV×500 A circuit was interrupted 20,000 times showed the high frequency of occurrence and variability of restriking of 1.31 to 2.05% i.e. it was much worse than the case of the working example 31, taken as standard, of {60 weight % Mo—$Cu_2Sb$ balance Cu} alloy and so was undesirable.

Regarding the contact resistance characteristic after measurement of the restriking characteristic, in working example 30, due to the Cu content in the alloy, this was approximately halved (40.2 to 58.7), taking the value in the case of working example 30 as 100 i.e. it exhibited in most regions a low and stable contact resistance characteristic.

In contrast, in the case of alloy of Mo content {50 weight % Mo—$Cu_2Sb$-balance Cu} as in working example 30 and the alloy {60 weight % Mo—$Cu_2Sb$-balance Cu} as in working example 32, restriking frequencies of occurrence in the allowed ranges of 0.86 to 0.90 and 0.83 to 0.85 were displayed. The contact resistance ranges shown were 95.1 to 121, and 112.6 to 135.4, which present no practical problems, taking the value of practical example 31 as 100.

In contrast, in the case of the alloy {82 weight % Mo $Cu_2Sb$-balance Cu} of comparative example 15, although a stable frequency of occurrence of restriking characteristic in the range 0.8 to 0.84 was displayed, the contact resistance was extremely high at 683.5 to 1553.1, and showed large variability, to the extent that this could not be practically used. In addition, in an another test, it was found that the temperature rise during conduction was high. It was found that interruption of 500 A produced local tortoise shell-shaped cracks by overheating at the contact surfaces. In addition, generation of enormous cracks and partial exfoliation thereof at the interruption surface were seen. As a result, although the restriking characteristic in comparative example 15 was in the desired range, the contact resistance was, in some places, very high, caused chiefly by deterioration of conductivity and generation of Joule heating, due to insufficiency of the Cu content.

Thus, in the case of the alloy {44% Mo—$Cu_2Sb$-balance Cu} of comparative example 14, frequent occurrence of restriking and a considerable increase in the contact resistance are seen, and, in the case of the alloy {82% Mo—$Cu_2Sb$-balance Cu} of comparative example 15, a further large increase in contact resistance is seen; these are therefore undesirable. It was found that, in accordance with the object of the present invention, overall stability was shown when the Mo content was in the range 50 to 75 weight % as shown in working examples 30 to 32.

Working Examples 33 to 36

In the working examples 30 to 32 described above, the benefits were illustrated where the W content in the alloy {Mo—$Cu_2Sb$-balance Cu} is 0 (zero), but the benefits of the present invention are not displayed solely in this case.

Specifically, when the W content was made 0.001 to 5% in the alloy {60 weight % Mo—$Cu_2Sb$-balance Cu} in working examples 33 to 36 as shown in the table of FIG. 4, relative values of 0.84 to 0.88 were displayed, taking the restriking characteristic of working example 31 as 1.00 i.e. a restriking characteristic of the same stability as the characteristic of the standard working example 31 was displayed. Also, taking the contact resistance of working example 31 as 100, relative values of 90.6 to 129.0 were displayed i.e. a contact resistance characteristic of the same stability as the characteristic of the standard working example 31 was displayed.

On observation of the contact surface, it is found that the presence of a prescribed content of W tends to suppress, to a certain degree, chipping of Mo. However, in the case of comparative example 16, where the Mo content was 12%, a restriking characteristic of 0.86 to 1.36 was displayed, which is in the desired range, and a restriking characteristic which was practically the same as the characteristic of working example 31, which was taken as standard, was displayed.

However, the contact resistance percentage multiple of comparative example 16 displayed values of 122.3 to 259.5 i.e. considerable variability was observed from the characteristic of working example 1, which was taken as standard, which was undesirable. Also, in observations of the contact surface, the benefit in terms of suppression of chipping of Mo was found to be small, integrated grains of WMo being found to be in a compositionally segregated condition. When such segregation is present, variability of the restriking characteristic and contact resistance tended to occur. It was therefore judged that overall stability was displayed in a range of added W content of 0.001 to 5% as shown in working examples 33 to 36.

Working Examples 37 and 38

In working examples 30 to 32 and comparative examples 14 and 15 described above, the benefits were described when the Mo content in the alloy (Mo—$Cu_2Sb$-balance Cu} was 44 to 82 weight %, the mean grain size of the Mo being 1.5 μm, and also in the case where, in working examples 33 to 36 and, comparative example 16, the W content in the {MoW—$Cu_2Sb$-balance Cu} alloy was 0.001 to 12 weight %, the mean grain size of the MoW integrated grains being 1.5 μm. However, the benefits of the present invention are not displayed solely when the mean grain size is restricted to 1.5 μm.

Specifically; when, as in the working examples 37 and 38 of the table of FIG. 3, {60 weight % W—$Cu_2Sb$-balance Cu} alloy is employed in which the W content is 0 and the Mo content is 60 weight %, even though the mean grain size was 0.4 μm to 9 μm. relative values of the rate of occurrence of restriking of 0.79 to 0.97 were displayed, i.e. a characteristic was displayed of the same stability as the characteristic of the standard working example 31.

Regarding the contact resistance percentage multiple also, relative values of 90.4 to 131.3 were displayed, taking working example 31 as 100; it can be seen that this is a substantially desirable range.

In contrast, when the mean grain size of the Mo was made 0.1 μm as shown in comparative example 17, although the contact resistance percentage multiple was in the very desirable range of 86.0 to 94.6, the restriking rate of occurrence percentage multiple was 2.39 to 2.86 i.e. there was a severe deterioration of the restriking characteristic from the characteristic of the standard working example 31; this was therefore undesirable. The reasons for this are believed to be that, when the gas content of the contact blanks was examined it was found that this had not been fully removed and residual gas was left, caused by the fact that the mean grain size of the Mo that was used was extremely fine at 0.1 μm; it is thought that this influenced in particular the frequent occurrence of restriking.

Also, as shown in comparative example 18, the percentage multiple of the rate of occurrence of restriking when the mean grain size was comparatively coarse at 15 μm showed the relative values of 3.08 to 5.65 (times) i.e. it displayed considerable variability in comparison with the characteristic of working example 2 which was taken as standard; thus it displayed a characteristic which was inferior in regard to stability. The contact resistance percentage multiple in comparative example 18 also showed relative values of 112.9 to 745.4 times, taking that of working example 31 as 100 i.e. it showed a substantially undesirable range. It should be noted that, owing to the frequent occurrence of restriking, evaluation was not made for the prescribed 20,000 times, but was discontinued at 2000 times. The gas content in the contact blanks was much larger.

Working Examples 39 to 44

In regard to the auxiliary constituent in the alloy {Mo—$Cu_x$Sb-balance Cu}, working examples 30 to 38 described above were indicated in terms of the effect when x=2, but the benefits of the present invention are solely not displayed in this case.

Specifically, when x in the auxiliary constituent $Cu_x$Sb was taken as 1.9 to 5.5, as in the case of working examples 39 to 44 of the table of FIG. 4, relative values of 0.86 to 1.0 times were obtained, taking the restriking characteristic of working example 31 as 1.00 i.e. restriking characteristics were obtained of the same stability as the restriking characteristic of working example 31, which was taken as standard. Taking the contact resistance of working example 31 as 100, in the case of working examples 39 to 44 relative values of 0.6. to 117.3 times were displayed i.e. a contact resistance characteristic of the same stability as the characteristic of the standard working example 31 was displayed.

In contrast, where, as in the case of comparative example 19, x in $Cu_x$Sb W was less than 1.9, although the contact resistance percentage multiple was in the range 93.1 to 117.9 i.e. represented an equivalent characteristic to that of the working example 31 which was taken as standard, the percentage multiple of occurrence of restriking showed values of 0.88 to 3.97 i.e. it showed large variability in comparison with the characteristic of the standard working example 31; this was therefore undesirable.

The reason for this is that because x in $Cu_x$Sb W in comparative example 19 was made less than 1.9, the Sb distribution cannot be fully uniformly dispersed, so, depending on the location, wide regions exist in which Sb is not present (segregation of Sb).

From the above, it was concluded that x in the alloy {Mo—$Cu_x$Sb—Cu} is preferably in the range x=1.9 to 5.5.

Working Examples 45 to 47

Although, in working examples 30 to 44 described above, the benefits were indicated when the content of auxiliary constituent $Cu_x$Sb in the alloy {Mo—$Cu_x$Sb-balance Cu} was 0.11 weight %, the benefits of the present invention are not solely shown in this case.

Specifically, as shown in working examples 45 to 47 of the table of FIG. 4, when the content of $Cu_x$Sb is made 0.09 to 1.4%, relative values of 0.84 to 0.96 times are displayed, taking the restriking characteristic of working example 31 as 1.00 i.e. a restriking characteristic is displayed of the same stability as the restriking characteristic of the standard working example 31. Taking the contact resistance of working example 31 as 100, relative values of 99.7 to 146.6 times are displayed i.e. a contact resistance characteristic of the same stability as the characteristic of working example 31, which is taken as standard, is displayed.

On the other hand, when, as in the case of comparative example 20, x in $Cu_x$Sb is made 2 and its content is made 0.03 weight %, relative values of 85.5 to 91.1 times are displayed, taking the contact resistance of working example 31 as 100 i.e. a contact resistance characteristic is displayed which is of the same stability as the characteristic of working example 31, which is taken as standard. However, also in comparative example 20, taking the restriking characteristic of working example 31 as 1.00, a restriking percentage multiple of 0.21 to 2.36 times is displayed i.e. severe variability is displayed in comparison with the characteristic of working example 31, which is taken as standard. The reason is that, due to technical reasons during the manufacture of the alloy, it was not possible to obtain economically an alloy in which the $Cu_x$Sb was fully uniformly dispersed.

Furthermore, when, as in the case of comparative example 21, x in the $Cu_x$Sb was made 2 and its content was made 2.3 weight %, taking the contact resistance of working example 31 as 100, relative values of 172.4 to 423.7 times were displayed i.e. a contact resistance characteristic of severe variability in comparison with the characteristic of working example 31 which was taken as standard is displayed.

Also, in comparative example 21, taking the restriking characteristic of working example 31 as 1.00, a restriking percentage multiple of 1.92 to 6.26 times was displayed i.e. severe variability was displayed in comparison with the characteristic of working example 31, which was taken as standard. This was due to the silver soldering tending to be poor, due to excess $Cu_x$Sb content, and to it not being possible to obtain economically an alloy in which the $Cu_x$Sb was uniformly dispersed.

From the above, it was concluded that, as shown in the working examples 45 to 47, the content of auxiliary constituent $Cu_x$Sb in the {Mo—$Cu_x$Sb—Cu} alloy should preferably be in the range 0.09 to 1.4 weight %.

Working Examples 48, 49

Although, in the working examples 30 to 47 described above, the benefits were illustrated in the case where the size of the auxiliary constituent $Cu_x$Sb grains in the {Mo—$Cu_x$Sb-balance Cu} alloy was 7 $\mu$m, the benefits of the present invention are not solely displayed in this case.

Specifically, as shown in working examples 30 to 44 of the table of FIG. 4, when the size of the $Cu_x$Sb grains was made 0.02 to 20 $\mu$m, taking the restriking characteristic of working example 31 as 1.00, relative values of 0.85 to 0.90 times were displayed i.e. a restriking characteristic of the same stability as the characteristic of working example 31, which was taken as standard, was displayed. Regarding the contact resistance characteristic also, taking the contact resistance of working example 31 as 100, relative values of 92.0 to 118.6 times were displayed i.e. a contact resistance characteristic was displayed of same stability as the characteristic of working example 31, taken as standard.

In contrast, as shown in comparative example 22, if the size of the auxiliary constituent $Cu_x$Sb grains was made less than 0.02 $\mu$m, taking the contact resistance of working example 31 as 100, the test was discontinued and excluded from the effective range, since it was difficult to mass produce contact blanks having a structure in which the $Cu_x$Sb grains were uniformly dispersed at the micro level.

Furthermore, as shown in comparative example 23, if the size of the $Cu_x$Sb grains is taken as 34 $\mu$m, taking the contact resistance of working example 31 as 100, relative values of 205.5 to 396.5 times are displayed i.e. the contact resistance characteristic showed severe deterioration and large variability compared with the characteristic of working example 31 taken as standard. Also, taking the restriking characteristic of working example 31 as 1.00, restriking percentage multiples of 0.89 to 2.34 times are displayed, representing considerable variability in comparison with the characteristic of working example 31 taken as standard.

The reasons for this are: due to the presence of coarse $Cu_xSb$ grains of large contact resistance, the problem of the probability of the contact point being located exactly above one of these coarse $Cu_xSb$ grains, resulting in large variability of the contact resistance being displayed; poor silver soldering tending to occur due to the large content of $Cu_xSb$ grains which are of poor joining characteristics; and it not being possible to obtain economically an alloy in which the $Cu_xSb$ is sufficiently uniformly dispersed.

For these reasons, it is preferable that the size of the auxiliary constituent $Cu_xSb$ in the {Mo—$Cu_xSb$—Cu} should be in the range 0.02 to 20.0%.

Working Examples 50 to 53

In working examples 30 to 49 described above, the benefits were described of the case where the mean distance between grains of the auxiliary constituent $Cu_xSb$ grains in the {Mo—$Cu_xSb$-balance Cu} alloy was 25 μm, but the benefits of the present invention are not solely shown in this case.

Specifically, if the mean distance between grains of $Cu_xSb$ grains of working examples 50 to 53 of the table of FIG. 4 is taken as 0.2 to 300 μm, taking the restriking characteristic of working example 31 as 1.00, relative values of 0.82 to 1.11 times are displayed i.e. a restriking characteristic is displayed which is of the same stability as the characteristic of working example 31, taken as standard. Also in the case of the contact resistance characteristic, if the contact resistance of working example 31 is taken as 100, relative values of 90.5 to 137.5 times are displayed i.e. a contact resistance characteristic of the same stability as the characteristic of working example 31 taken as standard is displayed.

In contrast, as shown in comparative example 24, if the mean distance between grains of the auxiliary $Cu_xSb$ grains was made less than 0.2 μm, just as in the case of comparative example 22 described above, i.e. when the mean distance between $Cu_xSb$ grains was made less than 0.2 μm, the test was discontinued and excluded from the effective range of invention, since it was difficult to mass produce contact blanks having a structure in which these were uniformly dispersed at the micro level.

Furthermore, when, as in comparative example 25, the mean distance between grains of the $Cu_xSb$ grains was made 600 μm, taking the restriking characteristic of working example 31 as 1.00, a restriking percentage multiple of 1.94 to 5.30 times was displayed. Also, in comparative example 25, compared with the characteristic of working example 31 which was taken as standard, severe deterioration and large variability were displayed. Also, taking the contact resistance of working example 31 as 100, relative values of 122.3 to 261.7 times are displayed i.e. a contact resistance characteristic which is markedly inferior and shows considerable variability is displayed, compared with the characteristic of working example 31 which was taken as standard.

Since the distance between adjacent grains of the $Cu_xSb$, which are of high contact resistance is made large, the distance between Cu phase or CuSb alloy phase, which is of comparatively low contact resistance, also becomes large; consequently, a coarse structural condition is produced, resulting in large variability of contact resistance, depending on the position of the contact point. Regarding the restriking characteristic also, similar variability is displayed, dependent on the position of the cathode spot, due to the coarse structural condition; thus, the restriking value also shows considerable variability.

From the above, it is desirable that the mean distance between grains of the auxiliary constituent $Cu_xSb$ in the {Mo—$Cu_xSb$—Cu} alloy should be in the range 0.2 to 300 μm, as shown in working examples 50 to 53.

Working Examples 54 to 56

In working examples 1 to 53 described above, the benefits were described of the case where the content of Sb (content of Sb in solid solution in the CuSb solid solution) in the conductive constituent in the {Mo—$Cu_xSb$-balance Cu} alloy was 0.01 weight %, but the benefits of the present invention are not restricted to this case.

Specifically, as shown in working examples 54 to 56 of the table of FIG. 4, when the Sb content in the conductive constituent was made 0.004 to 0.5 μm, taking the restriking characteristic of working example 31 as 1.00, relative values of 0.86 to 0.97 times were displayed i.e. a restriking characteristic of the same stability as the characteristic of working example 31 which was taken as standard is displayed. Regarding the contact resistance characteristic also, taking the contact resistance of working example 31 as 100, relative values of 95.7 to 138.2 times were displayed i.e. a contact resistance characteristic of the same stability as the characteristic of working example 31 taken as standard was displayed.

However, when, as in the case of comparative example 26, the content of Sb in the conductive constituent was made more than 0.5 μm, taking the restriking characteristic of working example 31 as 1.00, restriking percentage multiples of 0.90 to 2.01 times were displayed; thus it will be seen that this was inferior to the characteristic of working example 31, which was taken as standard. Also, in this comparative example 26, taking the contact resistance of working example 31 as 100, relative values of 372.4 to 586.8 times were displayed i.e. considerable deterioration and large variability of contact resistance characteristic were displayed compared with the characteristic of working example 31, which was taken as standard.

Working Examples 57, 58

In working examples 30 to 56 described above, the benefits when CuSb solid solution was employed as the conductive constituent in {Mo—$Cu_xSb$-balance Cu} alloy were illustrated, but the benefits of the present invention are not restricted to this case.

Specifically, in both the case where the conductive constituent is {Cu+CuSb solid solution} as it is in working example 57 of the table of FIG. 4, and where it is {Cu} as it is in working example 58, taking the restriking characteristic of working example 31 as 1.00, relative values of 0.86 to 0.96 times are displayed i.e. a restriking characteristic of the same stability as the characteristic of working example 31 taken as standard is obtained. Regarding the contact resistance characteristic also, taking the contact resistance of working example 31 as 100, relative values of 86.3 to 117,0 times are displayed i.e. a contact resistance characteristic of the same stability as working example 2 taken as standard are displayed.

It should be noted that, although, in the above working examples 1 to 56, the benefits in terms of restriking characteristic and contact resistance characteristic when the surface roughness (Rave.) of the contact surfaces after manufacture of the {Mo—$Cu_xSb$-balance Cu} alloy was made to be 2 μm were illustrated, the benefits of the present invention are not restricted to this case.

Specifically, even when the mean surface roughness (Rave.) is made less than 10 μm, down to a minimum value (Rmin.) of more than 0.05 μm, a contact resistance characteristic of the same stability as the characteristic of working example 31 taken as standard is displayed.

Although, in the above working examples 1 to 58, the benefits in terms of restriking characteristic and contact resistance characteristic when the electrical circuit was constituted by direct silver soldering of {Mo—$Cu_x$Sb balance Cu} alloy on the electrode or conductive rod were illustrated, the benefits of the present invention are not manifested solely in this case.

Specifically, even when silver solderability is improved by applying a Cu layer having a thickness of at least 0.3 mm to the faces of the {Mo—$Cu_x$Sb-balance Cu} alloy other than the contact surface, restriking characteristics and contact resistance characteristics of the same stability as the characteristics of working example 31, which was taken as standard, are displayed.

In the above working examples 1 to 58, the benefits in terms of the restriking characteristic and contact resistance characteristic when the surface roughness (Rave.) of the contact surface was made to be 2 μm after manufacture of the {Mo—$Cu_x$Sb-balance Cu} alloy were indicated, but an even more stable restriking characteristic and contact resistance characteristic can be obtained by surface finishing performed by interrupting of currents of 1 to 10 mA in a condition with a voltage of at least 10 kV applied, at the contact surface formed by the {Mo—$Cu_x$Sb-balance Cu} alloy.

It should be noted that the same benefits can be obtained whether a vacuum interrupter provided with contacts as described in the first and second embodiment described above is mounted in a vacuum switch or in a vacuum circuit breaker.

As described in detail above, with the present invention, {W—$Cu_x$Sb-balance Cu} alloy contacts are mounted, and as the anti-arcing constituent in the alloy W or WMo is employed; furthermore, a content thereof of 65 to 85%, of grain size 0.4 to 9 μm is employed. Furthermore, as auxiliary constituent, $Cu_x$Sb is employed, the content of the $Cu_x$Sb being 0.09 to 1.4 weight %, the x in $Cu_x$Sb being x=1.9 to 5.5, the grain size being 0.02 to 20 μm, and the mean distance between grains being 0.2 to 300 μm. Furthermore, as conductive constituent, Cu or CuSb solid solution is employed, the Sb content present in solid solution form in the CuSb solid solution being less than 0.5%. As a result, not only is dispersion of $Cu_x$Sb, which is selectively and preferentially evaporated on subjection to arcing, reduced, but also generation of severe cracks, which have an adverse effect in terms of occurrence of restriking, in the contacts surface by heat shock when subjected to arcing, is prevented, suppressing dispersion and exfoliation of W grains. In this way, improvements can be achieved such as making the alloy structure more uniform due to the $Cu_x$Sb, enabling damage due to melting and dispersion at the contacts surfaces to be reduced even after being subjected to arcing, and enabling restriking to be prevented and the contact resistance characteristic to be improved.

Furthermore, {Mo—$Cu_x$Sb-balance Cu} alloy contacts are mounted, and as the anti-arcing constituent in the alloy Mo or MoW is employed; furthermore, a content thereof of 50 to 75 weight %, of grain size 0.4 to 9 μm is employed. Furthermore, as auxiliary constituent, $Cu_x$Sb is employed, the content of the $Cu_x$Sb being 0.09 to 1.4 weight %, the x in $Cu_x$Sb being x=1.9 to 5.5, the grain size being 0.02 to 20 μm, and the mean distance between grains being 0.2 to 300 μm. Furthermore, as conductive constituent, Cu or CuSb solid solution is employed, the Sb content present in solid solution form in the CuSb solid solution being less than 0.5 weight %. As a result, not only is dispersion of $Cu_x$Sb, which is selectively and preferentially evaporated on subjection to arcing, reduced, but also generation of severe cracks, which have an adverse effect in terms of occurrence of restriking, in the contacts surface by heat shock when subjected to arcing, is prevented, suppressing dispersion and exfoliation of Mo grains. In this way, improvements can be achieved such as making the alloy structure more uniform due to the $Cu_x$Sb, enabling damage due to melting and dispersion at the contacts surfaces to be reduced even after being subjected to arcing, and enabling restriking to be prevented and the contact resistance characteristic to be improved.

Obviously, numerous additional modifications and variations of the present invention are possible in light of the above teachings. It is therefore to be understood that within the scope of the appended claims, the present invention may be practiced otherwise than as specially described herein.

What is claimed is:

1. A vacuum interrupter, which performs current interruption/conduction by opening/closure of contacts, comprising contacts having surfaces, wherein said contacts comprise a material, comprising:

W which has a mean grain size of 0.4 to 9 μm in an amount of 65 to 85 wt % based on the total weight of said material included in said contacts;

0.09 to 1.4 wt % of $Cu_x$Sb compound, wherein x has a value of from 1.9 to 5.5; and Cu or CuSb alloy as the balance.

2. The vacuum interrupter of claim 1, wherein said CuSb alloy contains in solid solution less than 0.5% of Sb.

3. The vacuum interrupter of claim 1, wherein said chemical compound $Cu_x$Sb is selected from the group consisting of $Cu_{5.5}$Sb, $Cu_{4.5}$Sb, $Cu_{3.65}$Sb, $Cu_{3.5}$Sb, $Cu_3$Sb, $Cu_{11}Sb_4$ and $Cu_2$Sb.

4. The vacuum interrupter of claim 1, wherein a mean grain size of said compound $Cu_x$Sb has a grain dimension of 0.02 to 20 μm.

5. The vacuum interrupter of claim 1, wherein grains of said compound $Cu_x$Sb are dispersed, the mean distance therebetween being 0.02 to 300 μm.

6. The vacuum interrupter of claim 1, wherein a mean surface roughness (Rave.) of said surfaces of said contacts is less than 10 μm, with a minimum value (Rmin.) of at least 0.05 μm.

7. The vacuum interrupter of claim 1, which further comprises a Cu layer having a thickness of at least 0.3 mm applied to a surface on an opposite side of said contact surface of said contacts.

8. The vacuum interrupter of claim 1, wherein surface finishing is performed on said contact surface of said contacts by interrupting a current of 1 to 10 mA in a condition with a voltage of at least 10 kV applied.

9. A vacuum switch, comprising the vacuum interrupter of claim 1, mounted therein.

10. A vacuum interrupter, which performs current interruption/conduction by opening/closure of contacts, comprising contacts having surfaces, wherein said contacts comprise a material comprising:

W which has a mean grain size of 0.4 to 9 μm in an amount of 65 to 85 wt % based on the total weight of said material included in said contacts;

Mo which has a mean grain size of 0.4 to 9 μm in an amount of 0.001 to 5 wt %, based on the total weight of said material included in said contacts, wherein said W and said Mo each have a mean grain size in the range of 0.4 to 10 μm;

0.09 to 1.4 wt % of $Cu_xSb$ compound, wherein x has a value of from 1.9 to 5.5; and Cu or CuSb alloy as the balance.

11. The vacuum interrupter of claim 10, wherein said CuSb alloy is in the balance, and contains in solid solution less than 0.5% of Sb.

12. The vacuum interrupter of claim 10, wherein said compound $Cu_xSb$ is selected from the group consisting of $Cu_{5.5}Sb$, $Cu_{4.5}Sb$, $Cu_{3.65}Sb$, $Cu_{3.5}Sb$, $Cu_3Sb$, $Cu_{11}Sb_4$ and $Cu_2Sb$.

13. The vacuum interrupter of claim 10, wherein a mean grain size of said compound $Cu_xSb$ has a grain dimension of 0.02 to 20 μm.

14. The vacuum interrupter of claim 10, wherein grains of said compound $Cu_xSb$ are dispersed, the mean distance therebetween being 0.02 to 300 μm.

15. The vacuum interrupter of claim 10, wherein a mean surface roughness (Rave.) of contact surfaces of said contacts is less than 10 μm, with a minimum value (Rmin.) of at least 0.05 μm.

16. The vacuum interrupter of claim 10, which further comprises a Cu layer having a thickness of at least 0.3 mm applied to a surface on the opposite side of said contact surface of said contacts.

17. The vacuum interrupter of claim 10, wherein surface finishing is performed on said contact surface of said contacts by interrupting a current of 1 to 10 mA in a condition with a voltage of at least 10 kV applied.

18. A vacuum switch, comprising the vacuum interrupter of claim 10, mounted thereon.

19. A vacuum interrupter, which performs current interruption/conduction by opening/closure of contacts, comprising contacts having surfaces, wherein said contacts comprise a material comprising:

Mo which has a mean grain size of 0.4 to 9 μm in an amount of 50 to 75 wt % based on the total weight of the material included in said contacts;

0.09 to 1.4 wt % of $Cu_xSb$ compound, wherein x has a value of from 1.9 to 5.5; and Cu or CuSb alloy as the balance.

20. The vacuum interrupter of claim 19, wherein said CuSb alloy is in the balance, and contains in solid solution less than 0.5% of Sb.

21. The vacuum interrupter of claim 19, wherein said compound $Cu_xSb$ is selected from the group consisting of $Cu_{5.5}Sb$, $Cu_{4.5}Sb$, $Cu_{3.65}Sb$, $Cu_{3.5}Sb$, $Cu_3Sb$, $Cu_{11}Sb_4$ and $Cu_2Sb$.

22. The vacuum interrupter of claim 19, wherein a mean grain size of said compound $Cu_xSb$ has a grain dimension of 0.02 to 20 μm.

23. The vacuum interrupter of claim 19, wherein grains of said compound $Cu_xSb$ are dispersed, the mean distance therebetween being 0.02 to 300 μm.

24. The vacuum interrupter of claim 19, wherein a mean surface roughness (Rave.) of contact surfaces of said contacts is less than 10 μm, with a minimum value (Rmin.) of at least 0.05 μm.

25. The vacuum interrupter of claim 19, which further comprises a Cu layer having a thickness of at least 0.3 mm applied to a surface on an opposite side of said contact surface of said contacts.

26. The vacuum interrupter of claim 19, wherein surface finishing is performed on said contact surface of said contacts by interrupting a current of 1 to 10 mA in a condition with a voltage of at least 10 kV applied.

27. A vacuum switch, comprising the vacuum interrupter of claim 19, mounted thereon.

28. A vacuum interrupter, which performs current interruption/conduction by opening/closure of contacts, comprising contacts having surfaces, wherein said contacts comprise a material comprising:

Mo which has a mean grain size of 0.4 to 9 μm in an amount of 50 to 75 wt % based on the total weight of said material included in said contacts;

W which has a mean size of 0.4 to 9 μm in an amount of 0.001 to 5 wt % based, wherein said Mo and said W each have a mean grain size in the range of 0.4 to 10 μm;

0.09 to 1.4 wt % of $Cu_xSb$ compound, wherein x has a value of from 1.9 to 5.5; and Cu or CuSb alloy as the balance.

29. The vacuum interrupter of claim 28, wherein said CuSb alloy contains in solid solution less than 0.5% of Sb.

30. The vacuum interrupter of claim 28, wherein said compound $Cu_xSb$ is selected from the group consisting of $Cu_{5.5}Sb$, $Cu_{4.5}Sb$, $Cu_{3.65}Sb$, $Cu_{3.5}Sb$, $Cu_3Sb$, $Cu_{11}Sb_4$ and $Cu_2Sb$.

31. The vacuum interrupter of claim 28, wherein a mean grain size of said compound $Cu_xSb$ has a grain dimension of 0.02 to 20 μm.

32. The vacuum interrupter of claim 28, wherein grains of said compound $Cu_xSb$ are dispersed, the mean distance therebetween being 0.02 to 300 μm.

33. The vacuum interrupter of claim 28, wherein a mean surface roughness (Rave.) of contact surfaces of said contacts is less than 10 μm, with a minimum value (Rmin.) of at least 0.05 μm.

34. The vacuum interrupter of claim 28, which further comprises a Cu layer having a thickness of at least 0.3 mm applied to a surface on an opposite side of said contact surface of said contacts.

35. The vacuum interrupter of claim 28, wherein surface finishing is performed on said contact surface of said contacts by interrupting a current of 1 to 10 mA in a condition with a voltage of at least 10 kV applied.

36. A vacuum switch, comprising the vacuum interrupter of claim 28, mounted thereon.

* * * * *